US011276940B2

(12) United States Patent
Nakamoto et al.

(10) Patent No.: US 11,276,940 B2
(45) Date of Patent: Mar. 15, 2022

(54) WAVEGUIDE SLOT ARRAY ANTENNA

(71) Applicant: Mitsubishi Electric Corporation, Tokyo (JP)

(72) Inventors: Narihiro Nakamoto, Tokyo (JP); Toru Fukasawa, Tokyo (JP); Shuji Nuimura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 29 days.

(21) Appl. No.: 17/032,720

(22) Filed: Sep. 25, 2020

(65) Prior Publication Data

US 2021/0013621 A1 Jan. 14, 2021

Related U.S. Application Data

(63) Continuation of application No. PCT/JP2018/017537, filed on May 2, 2018.

(51) Int. Cl.
*H01Q 21/00* (2006.01)
*H01Q 25/00* (2006.01)
(Continued)

(52) U.S. Cl.
CPC ..... *H01Q 21/005* (2013.01); *H01Q 5/55* (2015.01); *H01Q 13/18* (2013.01);
(Continued)

(58) Field of Classification Search
CPC ..... H01Q 21/005; H01Q 5/55; H01Q 13/18; H01Q 25/001; H01Q 21/24; H01Q 21/00;
(Continued)

(56) References Cited

U.S. PATENT DOCUMENTS 3,004,259 A * 10/1961 Shanks ..... H01Q 3/443 343/746
5,170,174 A 12/1992 Caer et al.
(Continued)

FOREIGN PATENT DOCUMENTS

CN 201413867 Y * 2/2010
JP 3-173205 A 7/1991
(Continued)

OTHER PUBLICATIONS

3D Printed Waveguide Slot Array Antennas. Gregory Peter Le Sage (Year: 2016).*

(Continued)

*Primary Examiner* — Vibol Tan
(74) *Attorney, Agent, or Firm* — Birch, Stewart, Kolasch & Birch, LLP

(57) ABSTRACT

A dielectric substrate is provided between a first waveguide member and a second waveguide member. The second waveguide member includes a plurality of slots for radiating a horizontally polarized wave. The dielectric substrate is provided with a plurality of line-shaped conductors arranged obliquely with respect to the waveguide axial direction and waveguide wall conductors as waveguide wall surfaces, and includes conductor-removed portions that function as vertically-polarized-wave radiation slot parallel to the waveguide axial direction. The waveguide wall conductors are connected by vias.

16 Claims, 14 Drawing Sheets

(51) Int. Cl.
*H01Q 5/55* (2015.01)
*H01Q 13/18* (2006.01)
*H01Q 21/06* (2006.01)

(52) U.S. Cl.
CPC ..... *H01Q 21/0062* (2013.01); *H01Q 21/064* (2013.01); *H01Q 25/001* (2013.01)

(58) Field of Classification Search
CPC ..... H01Q 21/0062; H01Q 21/064; H01Q 21/0037
See application file for complete search history.

(56) References Cited

U.S. PATENT DOCUMENTS 5,422,652 A * 6/1995 Caer ..... H01Q 21/0043 343/771
5,831,583 A * 11/1998 Lagerstedt ..... H01Q 21/24 343/771
8,149,177 B1 * 4/2012 Callus ..... H01Q 1/286 343/771
8,446,313 B2 * 5/2013 Miyagawa ..... H01Q 13/22 342/175
9,337,546 B2 * 5/2016 Watanabe ..... H01P 3/12
10,651,560 B2 * 5/2020 Roemer ..... H01Q 21/005
2020/0303823 A1 * 9/2020 Goto ..... H01P 1/161
2021/0005983 A1 * 1/2021 Yamaguchi ..... H01Q 21/24

FOREIGN PATENT DOCUMENTS

JP 2008-167246 A 7/2008
JP 4727568 B2 7/2011
JP 2012-204975 A 10/2012
WO WO-03044896 A1 * 5/2003 ..... H01Q 21/005

OTHER PUBLICATIONS

A Waveguide Slot Array Antenna Design for X-Band Radar. Yunus Emre Yamac, and Ahmet Kizilay. (Year: 2016).*
Herruzo et al., "Untilted Narrow-Wall Slots Excited by Parasitic Dipoles in Groove Gap Waveguide Technology", IEEE Transactions On Antennas and Propagation, vol. 63, No. 11, Nov. 2015, pp. 4759-4765.

* cited by examiner

WAVEGUIDE SLOT ARRAY ANTENNA

CROSS REFERENCE TO RELATED APPLICATIONS

This application is a Continuation of PCT International Application No. PCT/JP2018/017537, filed on May 2, 2018, which is hereby expressly incorporated by reference into the present application.

TECHNICAL FIELD

The present invention relates to a dual-orthogonal polarized waveguide slot array antenna for radiating both a horizontally polarized wave and a vertically polarized wave.

BACKGROUND ART

In recent years, the demand for effective use of frequencies has been increasing in addition to the demands for expansion of the communicable area of wireless communication and for extension of the detection range of radars, and in order to meet these demands, low-loss and highly efficient dual-orthogonal polarized array antennas are desired as antenna devices applied to wireless communication or radars.

Waveguide slot array antennas are one example of such low-loss and highly efficient antenna systems. The following Patent Literature 1 discloses a dual-orthogonal polarized waveguide slot array antenna structured by arranging a slot array that radiates a polarized wave orthogonal to a waveguide axial direction of a waveguide (hereinafter, referred to as a vertically polarized wave) and a slot array that radiates a polarized wave parallel to the waveguide axial direction of the waveguide (hereinafter, referred to as a horizontally polarized wave) adjacent to each other.

CITATION LIST

Patent Literature

Patent Literature 1: JP 2008-167246 A

SUMMARY OF INVENTION

Technical Problem

It is known that the radiation pattern of an array antenna depends on the excitation amplitude distribution of each of element antennas. In a waveguide slot array antenna, design parameters are adjusted so that the amount of radiation power from each of arrayed slots has a predetermined excitation amplitude distribution so as to implement a target radiation pattern. In the above-mentioned conventional waveguide slot array antennas for orthogonally polarized waves, the amount of radiation power is adjusted by, as for slots that radiate a vertically polarized wave, adjusting the slot shape (length thereof and distance from the waveguide axial center) or the like for each slot and, as for slots that radiate a horizontally polarized wave, adjusting mainly the shape of the irises.

Normally, in the development of waveguide slot array antennas, a product that achieves desired performance is finally fabricated through antenna development processes such as designing using electromagnetic field analysis or other analyses, fabricating a prototype, performance evaluation of radiation patterns or the like, prototype refabrication and re-evaluation by structural modification based on results of the performance evaluation (adjusting the amount of radiation power by modifying the shape of each slot). In particular, the processes of prototype refabrication and re-evaluation by structural modification based on performance evaluation results are often repeated several times until desired performance is implemented.

However, in the above-mentioned conventional waveguide slot array antenna, the amount of radiation power can be adjusted only by the slot shape (length thereof and distance from the waveguide axial center) for the slots that radiate a vertically polarized wave, and thus it is necessary to fabricate the waveguide with a modified slot shape by processing such as cutting every time a prototype is refabricated, which results in the disadvantage of an increased development cost.

The present invention has been made to solve the above-described disadvantage, and an object of the invention is to provide a waveguide slot array antenna that does not require remanufacturing of the waveguide for refabricating a prototype.

Solution to Problem

A waveguide slot array antenna according to the present invention includes: a first waveguide member having a first groove for forming a first waveguide, and a second groove for forming a part of a second waveguide; a second waveguide member having a third groove for forming another part of the second waveguide having a same width as a width of the second groove, the third groove being arranged to face the second groove, a bottom surface of the third groove having a plurality of slots each of which is arranged to be orthogonal to a waveguide axial direction; a dielectric substrate provided between the first waveguide member and the second waveguide member and covering the first groove and the second groove; waveguide wall conductors provided on both sides of the dielectric substrate, respectively, at portions in contact with the first waveguide member and the second waveguide member and a portion covering the first groove; a plurality of line-shaped conductors provided on the dielectric substrate at positions corresponding to the plurality of slots, respectively, each of the plurality of line-shaped conductors being provided obliquely with respect to the waveguide axial direction; a plurality of rectangular conductor-removed portions formed in the waveguide wall conductors in a position of the first groove, each of the plurality of rectangular conductor-removed portions being parallel to the waveguide axial direction; and a plurality of vias connecting the waveguide wall conductors on both the sides through the dielectric substrate.

Advantageous Effects of Invention

In a waveguide slot array antenna of the present invention, a dielectric substrate, provided between a first waveguide member and a second waveguide member, is provided with multiple line-shaped conductors arranged obliquely with respect to the waveguide axial direction and waveguide wall conductors serving as waveguide wall surfaces, conductor-removed portions that function as slots parallel to the waveguide axial direction and vias connecting the waveguide wall conductors on both sides of the dielectric substrate. As a result, the amount of radiation power can be adjusted only by modifying the conductor patterns on the dielectric substrate, and thus it becomes not necessary to remanufacture the waveguide for refabricating a prototype in an antenna development process.

DESCRIPTION OF EMBODIMENTS

To describe the invention further in detail, embodiments for carrying out the invention will be described below with reference to the accompanying drawings.

First Embodiment

Figure 1:
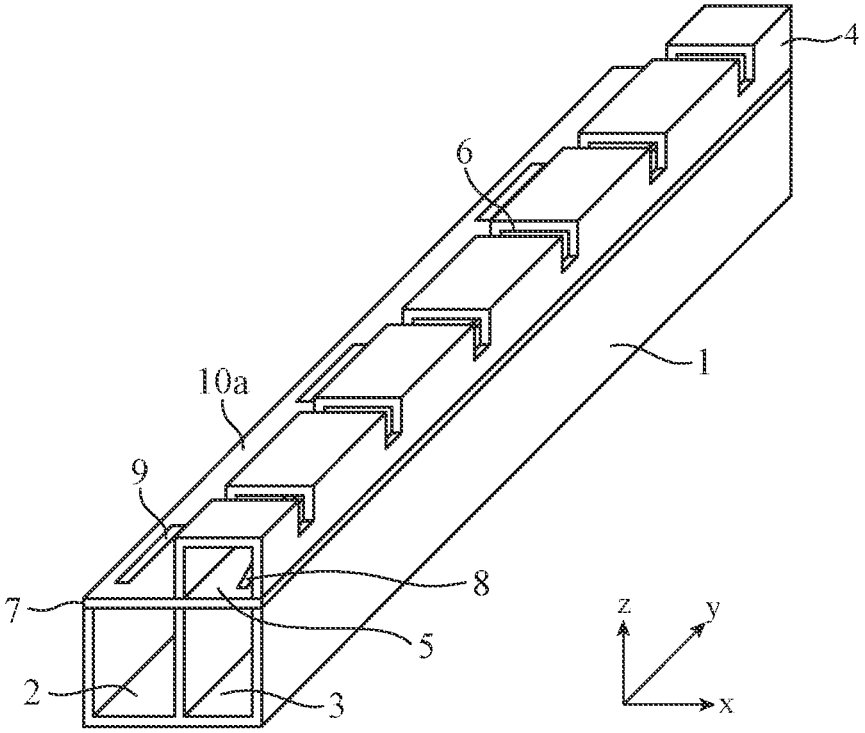
FIG. 1 is a perspective view of a waveguide slot array antenna according to a first embodiment of the present invention.
Figure 2:
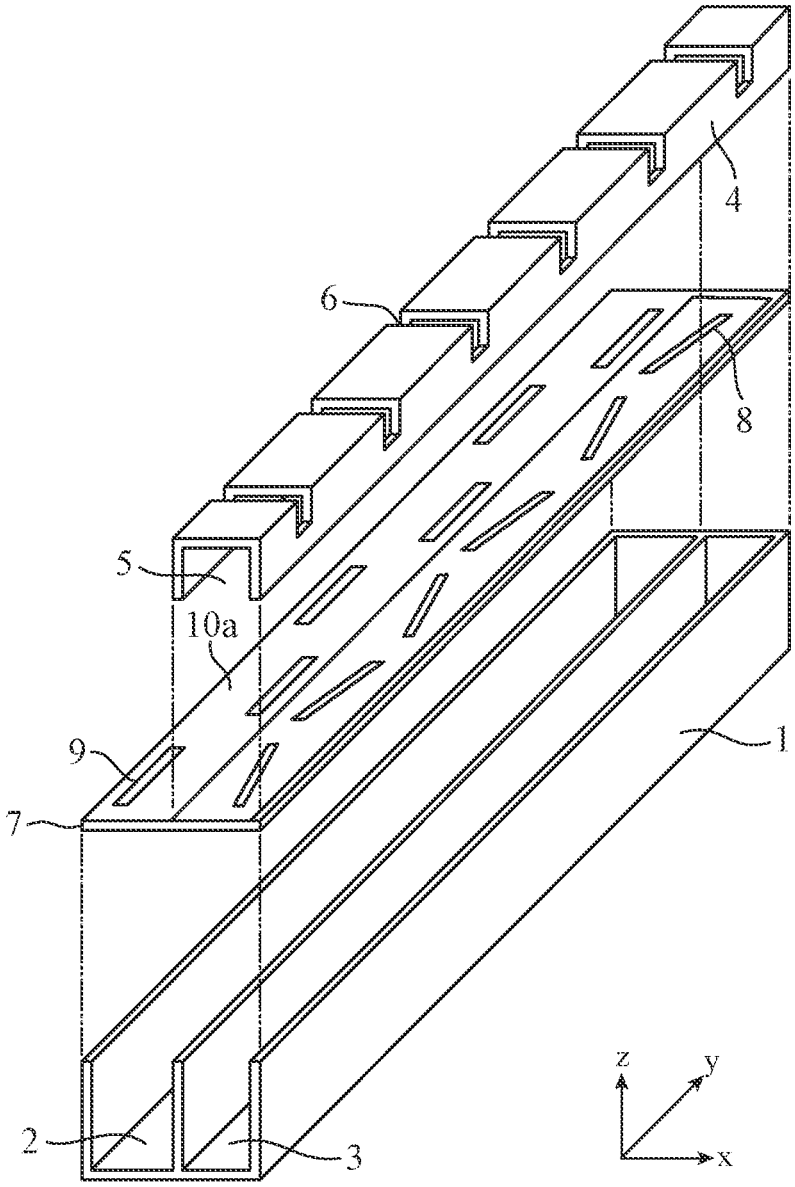
FIG. 2 is an exploded perspective view of the waveguide slot array antenna according to the first embodiment of the present invention.

FIG. 1 is a perspective view of a waveguide slot array antenna according to the present embodiment. In FIG. 2, an exploded perspective view of the waveguide slot array antenna is illustrated.

The waveguide slot array antenna illustrated in FIGS. 1 and 2 includes a first waveguide member 1, a second waveguide member 4, and a dielectric substrate 7. The first waveguide member 1 is a long member having a first groove 2 and a second groove 3 extending along the waveguide axial direction and having an E-shaped cross section intersecting the waveguide axial direction, and one end thereof is sealed with a short-circuit wall. The surfaces thereof are formed of a conductor. The first groove 2 and the second groove 3 form a first waveguide lower part and a second waveguide lower part, respectively. The second waveguide member 4 is a long member having a third groove 5 extending along the waveguide axial direction and having a C-shaped cross section intersecting the waveguide axial direction, and one end thereof is sealed with a short-circuit wall. The surfaces thereof are formed of a conductor. The width of the third groove 5 is formed to be the same as the width of the second groove 3, and the third groove 5 and the second groove 3 are arranged so as to face each other. Multiple slots 6 for radiation of a horizontally polarized wave are formed on the bottom surface of the third groove 5 in the second waveguide member 4, extending to a part of side surfaces. The slots 6 are formed so that the longitudinal directions thereof are orthogonal to the waveguide axial direction of the second waveguide member 4, and the multiple slots 6 are arranged at a predetermined interval.

Figure 3A:
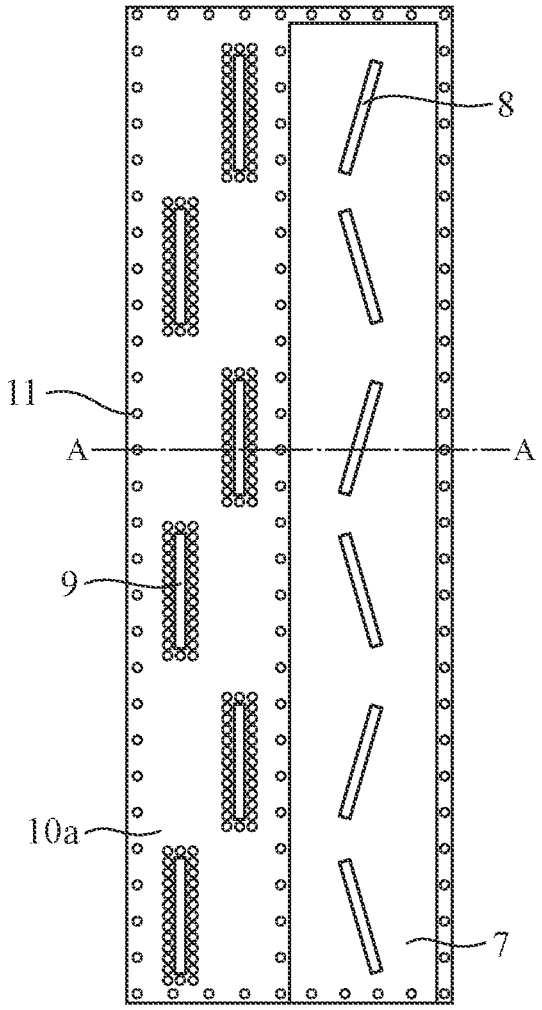
FIG. 3A is a plan view of a dielectric substrate of the waveguide slot array antenna according to the first embodiment of the present invention.
Figure 3B:
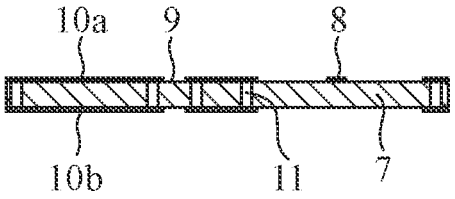
FIG. 3B is a cross-sectional view taken along line AA of FIG. 3A.

FIG. 3A is a plan view of the dielectric substrate 7, and FIG. 3B is a cross-sectional view of FIG. 3A taken along the line AA. The dielectric substrate 7 is a flat plate formed of a resin material, and line-shaped conductors 8 are provided on the surface on which the second waveguide member 4 is disposed. The conductor-removed portions 9 and the waveguide wall conductors 10*a* and 10*b* are formed on both the front and back surfaces of the dielectric substrate 7, and vias 11 are formed therein.

Each line-shaped conductor 8 is formed so that the longitudinal direction thereof is inclined by a set angle with respect to the waveguide axial direction of the second waveguide member 4, and multiple line-shaped conductors 8 are arranged corresponding to the arrangement intervals of the slots 6. Furthermore, the line-shaped conductors 8 are formed so that inclination angles of adjacent line-shaped conductors 8 are in opposite directions.

The conductor-removed portions 9 are formed by removing multiple portions of conductor patterns of the waveguide wall conductors 10*a* and 10*b* in rectangular shapes having long sides and short sides so that a longitudinal direction of each of the conductor-removed portions 9 is parallel to the waveguide axial direction of the first waveguide member 1. Furthermore, adjacent conductor-removed portions 9 are arranged to form a zig-zag arrangement so as to be at positions opposite to each other with respect to the waveguide axial center line of the first groove 2.

The vias 11 are formed inside the dielectric substrate 7, and the multiple vias 11 are formed around the conductor-removed portions 9 at a predetermined interval and at positions where the first waveguide member 1 and the second waveguide member 4 are connected at a predetermined interval so that the waveguide wall conductor 10*a* and the waveguide wall conductor 10*b* are electrically connected to each other. The vias 11 are formed at sufficiently narrow intervals so that no electromagnetic field leaks from portions between adjacent vias.

The waveguide wall conductors 10*a* and 10*b* are formed at a portion covering the first groove 2 and portions where the first waveguide member 1 and the second waveguide member 4 are in contact.

Next, the operation of the waveguide slot array antenna of the first embodiment will be described.

Figure 4:
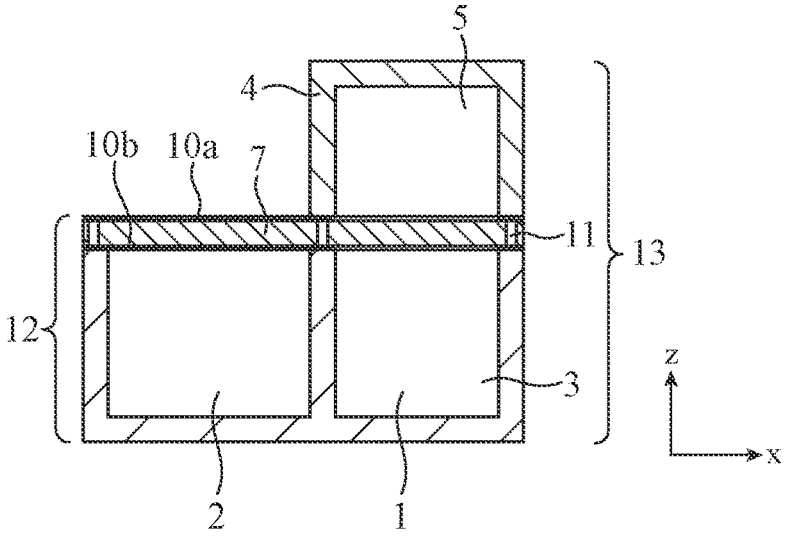
FIG. 4 is a cross-sectional view illustrating a cross-sectional shape of a waveguide of the waveguide slot array antenna according to the first embodiment of the present invention.

FIG. 4 is a diagram illustrating a cross-sectional shape of a waveguide of the waveguide slot array antenna according to the first embodiment.

In FIG. 4, an open end of the first groove 2 and the waveguide wall conductor 10*b* are electrically connected at the contact surfaces, thereby a first waveguide 12 is formed. The waveguide wall conductor 10*b* and the bottom surface of the first groove 2 each form wide wall surfaces of the first waveguide 12, and the side surfaces of the first groove 2 each form narrow wall surfaces of the first waveguide 12. In this example, the first waveguide 12 has a component, in which the electric field vector is oriented in the z-axis direction, as the dominant mode.

On the other hand, an open end of the second groove 3 and the second waveguide member 4 are electrically connected at contact surfaces by the waveguide wall conductors 10*a* and 10*b* and vias 11, and a second waveguide 13 is thereby formed. Multiple vias 11, which are arranged at the positions corresponding to the contact surfaces between the waveguide wall conductors 10*a* and 10*b* and each of the open end of the second groove 3 and the open end of the third groove 5, are densely arranged so that high frequency signals propagated inside the second waveguide 13 do not to leak to the outside. The side surfaces of each of the second groove 3 and the third groove 5, the waveguide wall conductors 10*a* and 10*b*, and the vias 11 form wide wall surfaces of the second waveguide 13, and the bottom surface of the second groove 3 and the bottom surface of the third groove 5 each form a narrow wall surface of the second waveguide 13. The second waveguide 13 has a component, in which the electric field vector is oriented in the x-axis direction, as the dominant mode.

Let us assume a case where a high frequency signal is input from each of power supply terminals (not illustrated) provided on the side opposite to the portions sealed with the short-circuit walls so that the dominant mode is propagated inside each of the first waveguide 12 and the second waveguide 13. In this case, since the one ends of the first waveguide 12 and the second waveguide 13 are short-circuit walls, so-called standing waves are excited inside both the waveguides.

Figure 5:
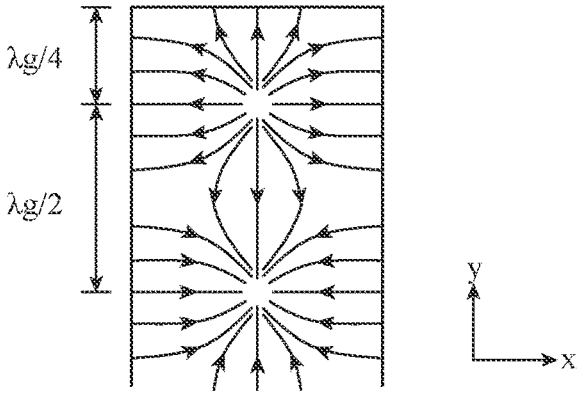
FIG. 5 is an explanatory diagram illustrating an electric current distribution on a waveguide wall conductor when a high frequency signal is input from a power supply terminal in the waveguide slot array antenna according to the first embodiment of the present invention.

First, the operation of the first waveguide 12 will be described. FIG. 5 is a diagram illustrating an electric current distribution on a wide wall surface of the first waveguide 12 near the short-circuit wall of the first waveguide 12, that is, the waveguide wall conductor 10*b*, when a high frequency signal is input from the power supply terminal. Note that in FIG. 5, an electric current distribution in a case where no conductor-removed portions 9 are formed is illustrated. As illustrated in FIG. 5, the intensity of a current flowing in the x-axis direction is stronger at the position $\lambda g/4$ away from the short-circuit wall, and there appears portions where the current intensity is stronger at the cycle of $\lambda g/2$ ($\lambda g$ denotes the in-waveguide wavelength at the center frequency of the input high frequency signal). Note that the direction of the current alternates in opposite directions at every $\lambda g/2$.

A conductor-removed portion 9 is disposed at a position where a large current flows in the x-axis direction so as to block the flow of the current. That is, a conductor-removed portion 9 is disposed at a position $\lambda g/4$ away from the short-circuit wall of the first waveguide 12, so that the longitudinal direction thereof is parallel to the axis of the first waveguide 12, with an offset of a predetermined distance from the waveguide axial center line of the first waveguide 12. A conductor-removed portion 9 disposed at such a position blocks a current in the conductor-removed portion 9, and as a result, an electric field parallel to the x axis is excited over the conductor-removed portion 9. Finally, a polarized wave orthogonal to the axis of the first waveguide 12, that is, a vertically polarized radio wave, is radiated to the external space, thereby allowing the conductor-removed portion 9 to operate as a vertically-polarized-wave radiation slot.

In this example, adjacent conductor-removed portions 9 are arranged to form a zig-zag arrangement so as to be positioned opposite to each other with respect to the waveguide axial center line of the first waveguide 12, thereby allowing radio waves radiated by the respective conductor-removed portions 9 to be in phase.

Furthermore, the amount of radiation power from each of the conductor-removed portions 9 is determined in accordance with the amount of offset from the waveguide axial center line of the first waveguide 12 and the size (width and length) of each of the conductor-removed portions 9, and thus the position and the size of each of the conductor-removed portions 9 are determined so that a predetermined excitation amplitude distribution is obtained.

The multiple vias 11 formed around the conductor-removed portions 9 prevent the electric field excited in each of the conductor-removed portions 9 from leaking to the inside of the dielectric substrate 7.

Figure 6:
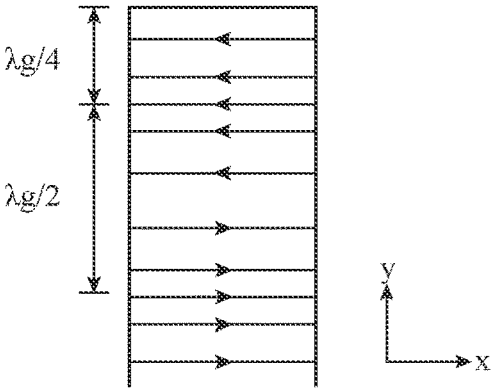
FIG. 6 is an explanatory diagram illustrating an electric current distribution of the waveguide slot array antenna on the bottom surface of a third groove when a high frequency signal is input from the power supply terminal according to the first embodiment of the present invention.

Next, the operation of the second waveguide 13 will be described. FIG. 6 is a diagram illustrating an electric current distribution on a narrow wall surface of the second waveguide 13 near the short-circuit wall of the second waveguide 13, that is, the bottom surface of the third groove 5, when a high frequency signal is input from the power supply terminal. Note that in FIG. 6, an electric current distribution in a case where neither the slots 6 nor the line-shaped conductors 8 are provided is illustrated. As illustrated in FIG. 6, the intensity of a current flowing in the x-axis direction is stronger at the position λg/4 away from the short-circuit wall, and there appears portions where the current intensity is stronger at the cycle of λg/2. Note that the direction of the current alternates in opposite directions at every λg/2.

A slot 6 is disposed at a position where a large current flows in the x-axis direction, that is, at the position λg/4 away from the short-circuit wall of the second waveguide 13, so that a radio wave is efficiently radiated to the outside. However, since the slot 6 is disposed so that the longitudinal direction thereof is orthogonal to the waveguide axial direction of the second waveguide 13, the current in the slot 6 portion cannot be efficiently blocked with this structure.

Figure 7:
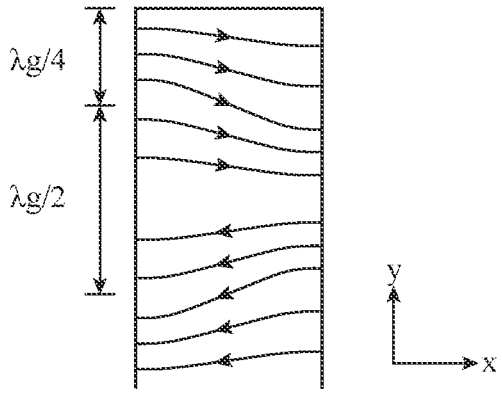
FIG. 7 is an explanatory diagram illustrating an electric current distribution of the waveguide slot array antenna on the bottom surface of the third groove when a high frequency signal is input from the power supply terminal in a case where line-shaped conductors are formed according to the first embodiment of the present invention.

Therefore, a line-shaped conductor 8 is formed on the dielectric substrate 7 positioned immediately below the slot 6 to disturb the electromagnetic field distribution inside the second waveguide 13. FIG. 7 is a diagram illustrating an electric current distribution on a narrow wall surface of the second waveguide 13 near the short-circuit wall of the second waveguide 13, that is, the bottom surface of the third groove 5, when a high frequency signal is input from the power supply terminal in a case where the line-shaped conductors 8 are provided. Note that illustrated in FIG. 7 shows an electric current distribution in a case where the slots 6 are not formed. Since a line-shaped conductor 8 is formed so as to be inclined at a set angle with respect to the waveguide axial direction of the second waveguide 13, the internal electromagnetic field distribution is disturbed by a current excited on the line-shaped conductor 8, and as a result, a current flowing in a direction oblique with respect to the waveguide axial direction of the second waveguide 13 is generated on the narrow wall surface of the second waveguide 13 as illustrated in FIG. 7. A slot 6 blocks this obliquely flowing current, and as a result, an electric field parallel to the y-axis is excited on the slot 6, and finally a polarized wave parallel to the axis of the second waveguide 13, that is, a horizontally polarized radio wave is radiated to the external space.

In this example, by forming adjacent line-shaped conductors 8 so that the inclination angles thereof are in opposite directions from each other, it is possible to make radio waves radiated from the slots 6 be in phase.

Furthermore, the amount of radiation power from a slot 6 is determined in accordance with the width and the length of the slot 6, the width, the length, the inclination angle, etc. of the line-shaped conductor 8, and thus the shapes of the slots 6 and the line-shaped conductors 8 are determined so that a predetermined excitation amplitude distribution is obtained.

As described above, in the waveguide slot array antenna of the first embodiment, the first waveguide member 1 and the second waveguide member 4 including the slots 6 sandwich the dielectric substrate 7 on which conductor patterns are formed. Conductor-removed portions 9 formed in the dielectric substrate 7 operate as vertically-polarized-wave radiation slots, and the amount of radiation power of a vertically polarized wave can be adjusted by the positions and the shapes of the conductor-removed portions 9. Furthermore, the amount of radiation power of a horizontally polarized wave can be adjusted by the shapes of the line-shaped conductors 8.

That is, the amount of radiation power can be adjusted only by modifying the shape of the conductor pattern on the dielectric substrate 7, and thus, in the waveguide slot array antenna of the first embodiment, remanufacturing of the waveguide is not required for refabricating a prototype in an antenna development process, and as a result, the development cost can be suppressed.

Figure 8A:
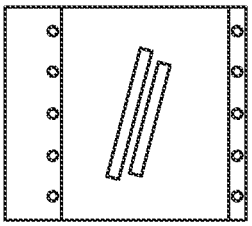
FIGS. 8A to 8C each are configuration diagrams illustrating modifications of the line-shaped conductor portion of a dielectric substrate.
Figure 8B:
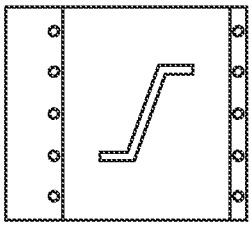
Figure 8C:
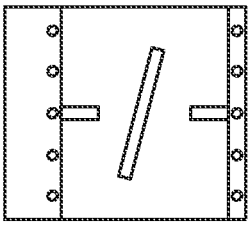

Note that, in the example illustrated in FIG. 3A, each of the line-shaped conductors 8 is a single line-shaped conductor pattern, and is arranged immediately below a slot 6. However, the shapes and the number of conductor patterns of the line-shaped conductors 8 may be desirably set as long as a current flowing obliquely with respect to the waveguide axial direction can be generated on the narrow wall surface of the second waveguide 13. For example, as illustrated in FIG. 8A, multiple parallel line-shaped conductor patterns may be formed. Note that, here, the multiple conductor patterns may not be completely parallel as long as the conductor patterns have the function as a line-shaped conductor 8. Alternatively, end portions of a line-shaped conductor pattern may be bent as illustrated in FIG. 8B, or two line-shaped extension conductors may be arranged on both sides of one line-shaped conductor pattern so that far ends of the extension conductors are connected with the waveguide wall conductor 10*a* as illustrated in FIG. 8C. In the case of the structure illustrated in FIG. 8C, the extension conductors are provided on the same straight line in a direction orthogonal to the waveguide axial direction.

In the case of the structure of FIG. 8A, the degree of freedom in adjusting the amount of radiation power can be enhanced as compared with the case where there is only one line-shaped conductor pattern. In the case of the structure illustrated in FIG. 8B, the length of the line-shaped conductor pattern in the waveguide axial direction can be shortened, and the influence of mutual coupling between adjacent line-shaped conductors 8 can be reduced. In the case of the structure illustrated in FIG. 8C, since parasitic reactance components generated by the line-shaped conductor 8 can be canceled by the extension conductors arranged on both sides, there is an effect that designing an antenna can be easier.

Furthermore, in the above example, the line-shaped conductor 8 is disposed only on the surface of the dielectric substrate 7 on which the waveguide wall conductor 10*a* is located as illustrated in FIG. 3B; however, a line-shaped conductor 8 may also be disposed on the other side (where the waveguide wall conductor 10*b* is positioned), and the two line-shaped conductors 8 may be connected by vias 11.

The same number of slots 6 and conductor-removed portions 9 are arranged in the examples illustrated in FIGS. 1 to 3; however, the number of slots 6 and the number of conductor-removed portions 9 may be different.

Figure 9:
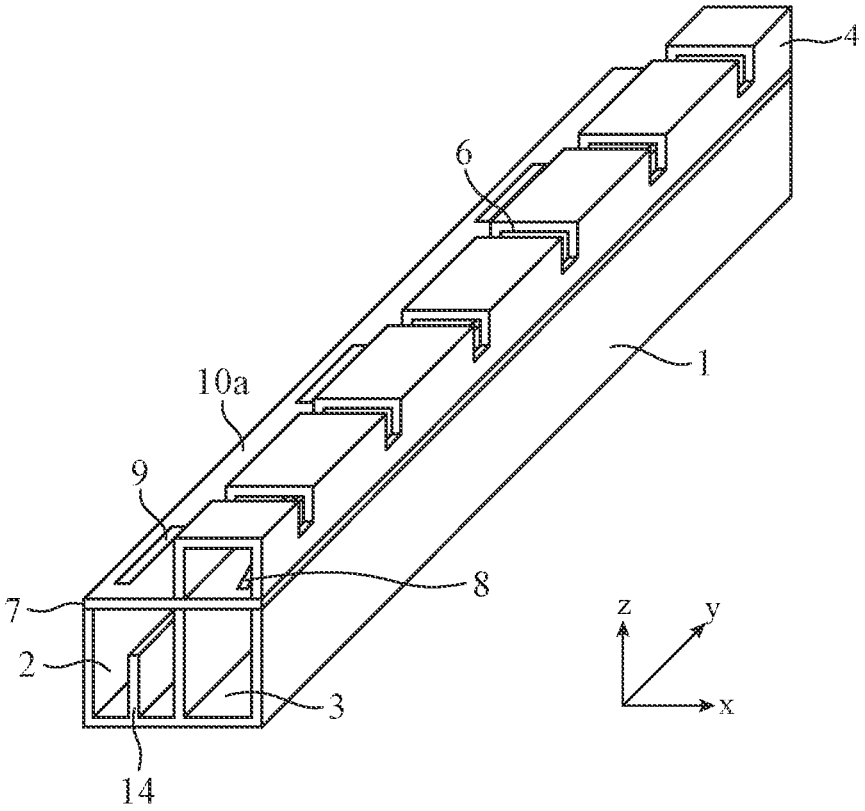
FIG. 9 is a perspective view of a modification of the waveguide slot array antenna according to the first embodiment of the present invention.
Figure 10:
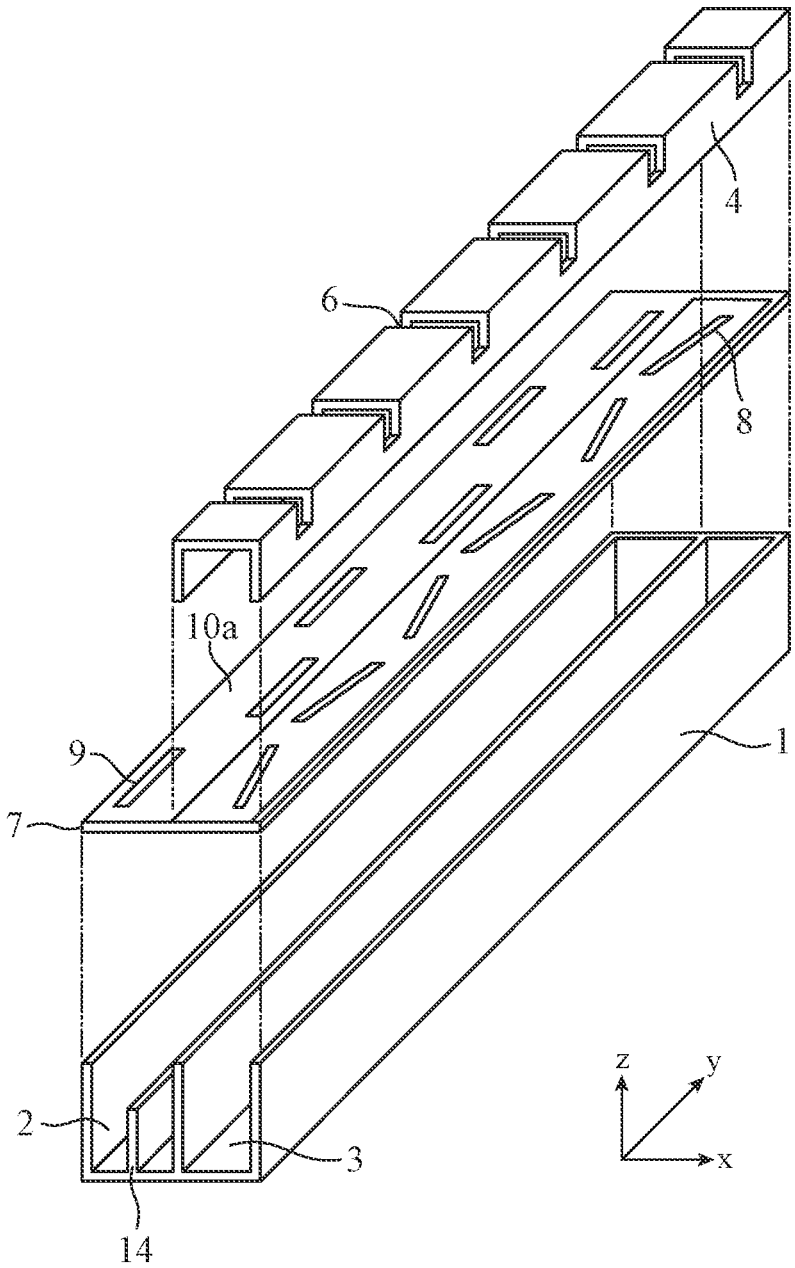
FIG. 10 is an exploded perspective view of the modification of the waveguide slot array antenna according to the first embodiment of the present invention.

Furthermore, the first waveguide 12 is a so-called rectangular waveguide whose cross-sectional shape has long sides and short sides in the waveguide slot array antenna illustrated in FIGS. 1 to 4; however, a first ridge conductor 14 which is a barrier having a set protruding length may be provided on the waveguide axial center line of the first groove 2 as illustrated as a modification in FIGS. 9 and 10 to make the first waveguide 12 a so-called ridge waveguide. FIG. 9 is a perspective view of the modification, and FIG. 10 is an exploded perspective view of the modification.

As described above, the waveguide slot array antenna of the first embodiment includes: a first waveguide member having a first groove for forming a first waveguide, and a second groove for forming a part of a second waveguide; a second waveguide member having a third groove for forming another part of the second waveguide having a same width as a width of the second groove, the third groove being arranged to face the second groove, a bottom surface of the third groove having a plurality of slots each of which is arranged to be orthogonal to a waveguide axial direction; a dielectric substrate provided between the first waveguide member and the second waveguide member and covering the first groove and the second groove; waveguide wall conductors provided on both sides of the dielectric substrate, respectively, at portions in contact with the first waveguide member and the second waveguide member and a portion covering the first groove; a plurality of line-shaped conductors provided on the dielectric substrate at positions corresponding to the plurality of slots, respectively, each of the plurality of line-shaped conductors being provided obliquely with respect to the waveguide axial direction; a plurality of rectangular conductor-removed portions formed in the waveguide wall conductors in a position of the first groove, each of the plurality of rectangular conductor-removed portions being parallel to the waveguide axial direction; and a plurality of vias connecting the waveguide wall conductors on both sides through the dielectric substrate. Therefore, it is possible to adjust the amount of radiation power only by modifying the conductor patterns on the dielectric substrate. Thus, it is not required to remanufacture the waveguide for refabricating a prototype in an antenna development process, and the development cost can be suppressed as a result.

According to the waveguide slot array antenna of the first embodiment, each of the plurality of line-shaped conductors includes a plurality of line-shaped conductor patterns being parallel to each other. Thus, the degree of freedom in adjusting the amount of radiation power can be enhanced.

Also according to the waveguide slot array antenna of the first embodiment, extension conductors each having one end connected to one of the waveguide wall conductors and another end extending toward one of the plurality of line-shaped conductors are included, the extension conductors being provided on the dielectric substrate on both sides of each of the plurality of line-shaped conductors to extend in a direction orthogonal to the waveguide axial direction. Thus, parasitic reactance components generated by the line-shaped conductors can be canceled by the extension conductors, and designing of an antenna can be easier.

Furthermore, according to the waveguide slot array antenna of the first embodiment, the extension conductors on both sides of any one of the plurality of line-shaped conductors are provided along the same linear line. Thus, designing of an antenna can be further easier.

Further, according to the waveguide slot array antenna of the first embodiment, a first ridge conductor positioned at a central part of the first groove in a direction orthogonal to the waveguide axial direction and extending in a direction parallel to the waveguide axial direction is included. Thus, the first waveguide can be structured as a ridge waveguide.

In addition, according to the waveguide slot array antenna of the first embodiment, in the waveguide axial direction, one end of each of the first waveguide member and the second waveguide member is a short-circuit wall and another end thereof is a power supply terminal, inclination directions of adjacent line-shaped conductors, among the plurality of line-shaped conductors, are in different directions from each other with respect to the waveguide axial direction, and positions of adjacent conductor-removed portions among the plurality of rectangular conductor-removed portions are on opposite sides from each other with respect to a center line extending in the waveguide axial direction of the first groove. Thus, the phases of radio waves radiated from the multiple slots can be in phase, and the phases of radio waves radiated from the multiple conductor-removed portions can be in phase.

According to the waveguide slot array antenna of the first embodiment, a distance between centers of the adjacent conductor-removed portions is one half of an in-waveguide wavelength at a design center frequency of a first waveguide including the first groove and the waveguide wall conductors, a distance between centers of adjacent slots among the plurality of slots is one half of an in-waveguide wavelength at a design center frequency of a second waveguide including the second groove, the third groove, the waveguide wall conductors, and the vias, and a distance in the waveguide axial direction between the short-circuit wall and a center of a conductor-removed portion adjacent to the short-circuit wall among the plurality of rectangular conductor-removed portions and a distance in the waveguide axial direction between the short-circuit wall and a center of a slot adjacent to the short-circuit wall among the plurality of slots is a quarter of an in-waveguide wavelength at a design center frequency of the first waveguide and the second waveguide, respectively. Therefore, a vertically polarized radio wave and a horizontally polarized radio wave can be efficiently radiated to the outside.

Further according to the waveguide slot array antenna of the first embodiment, the waveguide slot array antenna is formed by arranging a plurality of waveguide slot array antennas in a direction orthogonal to a waveguide axial direction as sub-arrays. Thus, an antenna that is densely arrayed in the direction orthogonal to the waveguide axial direction can be obtained.

Second Embodiment

Figure 11:
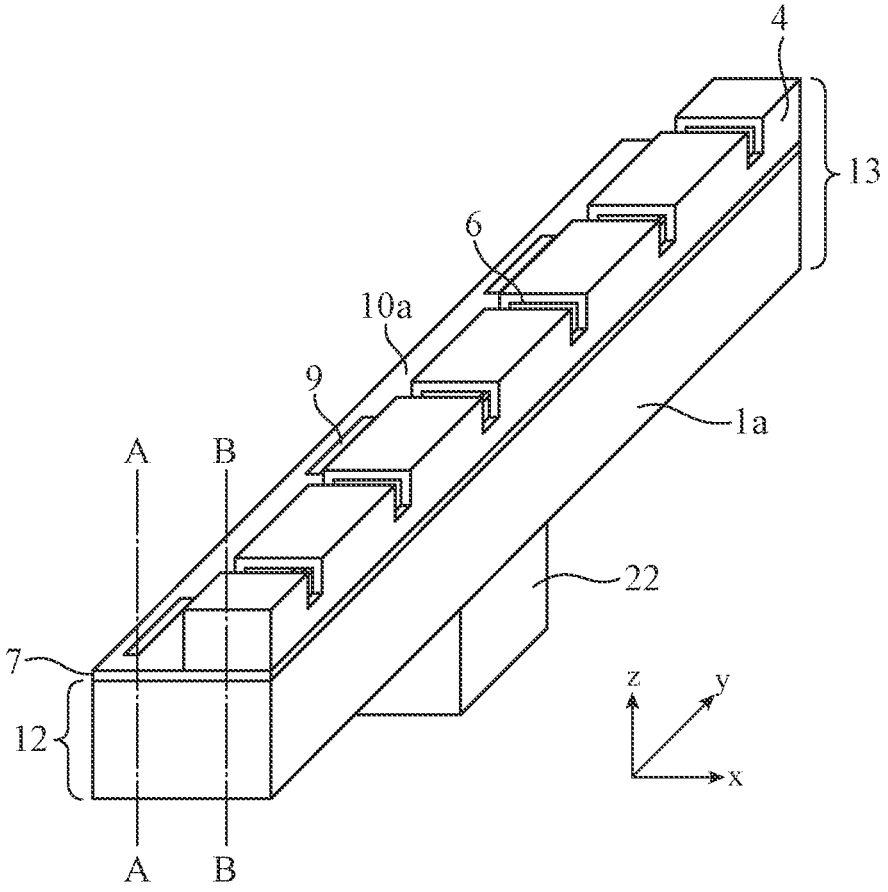
FIG. 11 is a perspective view of a waveguide slot array antenna according to a second embodiment of the present invention.
Figure 12:
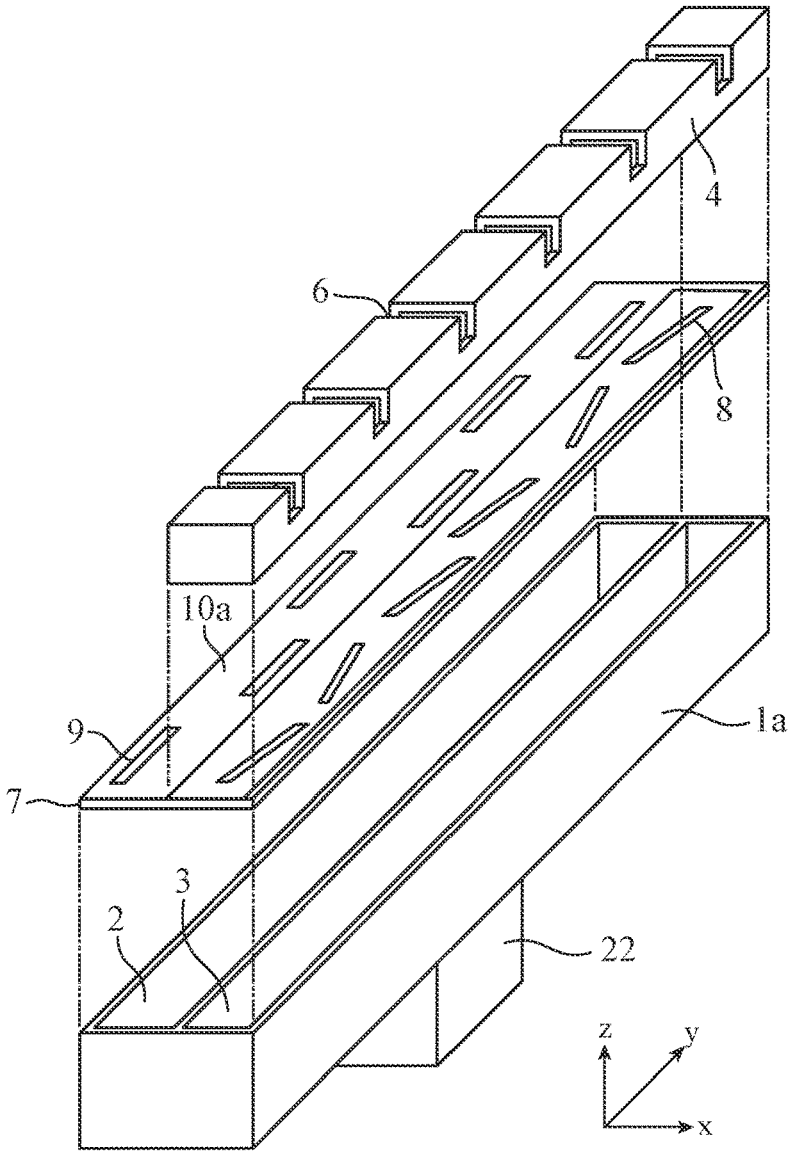
FIG. 12 is an exploded perspective view of the waveguide slot array antenna according to the second embodiment of the present invention.
Figure 13:
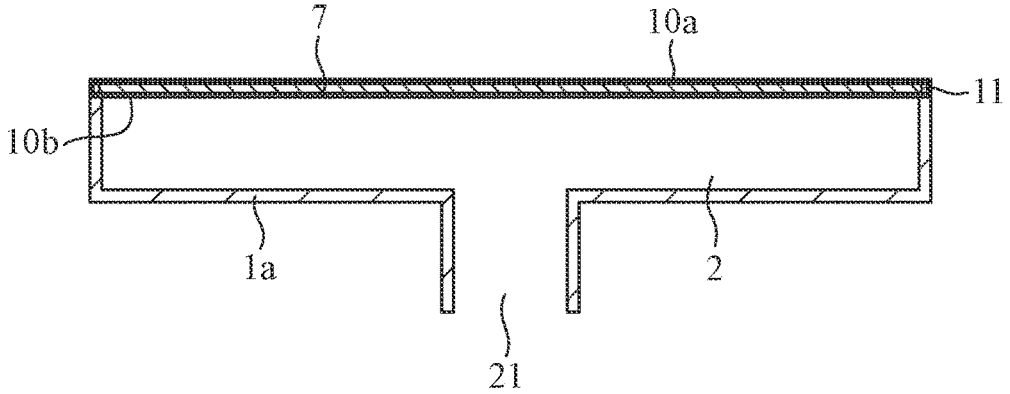
FIG. 13 is a cross-sectional view taken along a plane that is passing through line AA of FIG. 11 and is parallel to the waveguide axis.
Figure 14:
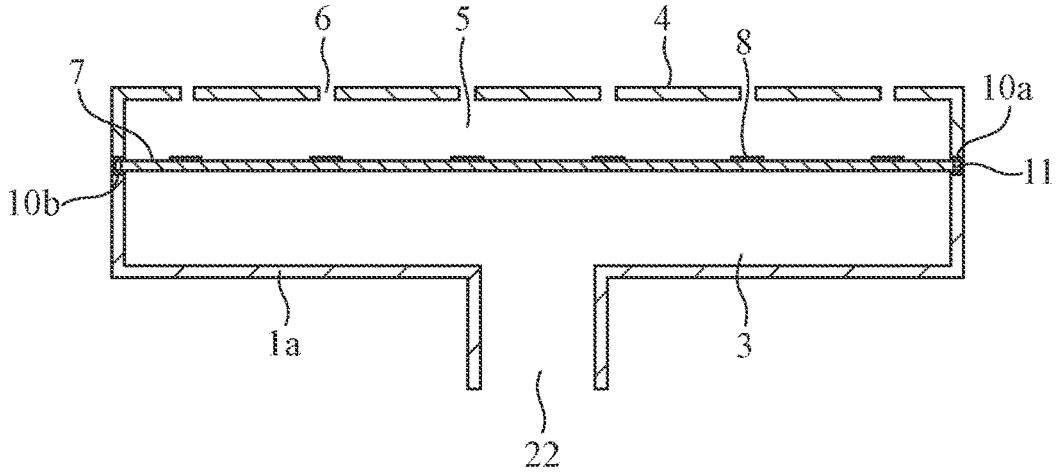
FIG. 14 is a cross-sectional view taken along a plane that is passing through line BB of FIG. 11 and is parallel to the waveguide axis.
Figure 15:
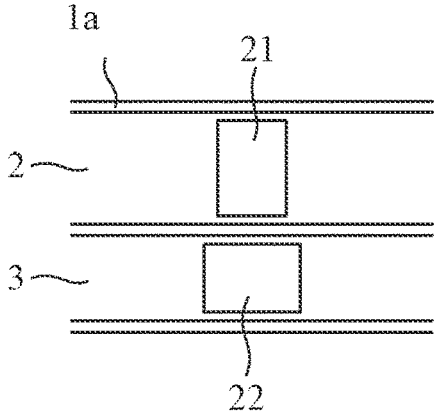
FIG. 15 is an explanatory diagram of a first feeding waveguide and a second feeding waveguide as viewed from the z-axis direction in the waveguide slot array antenna according to the second embodiment of the present invention.

A second embodiment is an example in which a waveguide T branch structure is provided in the central portion of a waveguide to obtain a branching waveguide as a power supply terminal. FIG. 11 is a perspective view of a waveguide slot array antenna according to the second embodiment. In FIG. 12, an exploded perspective view of the waveguide slot array antenna is further illustrated. FIG. 13 is a cross-sectional view taken along a plane that is passing through line AA of FIG. 11 and is parallel to a waveguide axis, and FIG. 14 is a cross-sectional view taken along a plane that is passing through line BB of FIG. 11 and is parallel to the waveguide axis. In addition, FIG. 15 is an explanatory diagram of a first feeding waveguide 21 and a second feeding waveguide 22 as viewed from the z-axis direction.

As illustrated in these figures, the waveguide slot array antenna according to the second embodiment includes a first waveguide member 1*a*, a second waveguide member 4, a dielectric substrate 7, line-shaped conductors 8, conductor-removed portions 9, waveguide wall conductors 10*a* and 10*b*, vias 11, a first feeding waveguide 21, and a second feeding waveguide 22. The first waveguide member 1*a* is formed with a first groove 2 and a second groove 3 like in the first embodiment, and both ends thereof in the waveguide axial direction are each sealed with a short-circuit wall. In addition, rectangular openings are formed in the central portions, in the waveguide axial direction, of the bottom surfaces of the first groove 2 and the second groove 3, and the first feeding waveguide 21 and the second feeding waveguide 22 are connected to the rectangular openings thereof, respectively. As illustrated in FIG. 15, the first feeding waveguide 21 and the second feeding waveguide 22 are rectangular waveguides having a cross-sectional shape having long sides and short sides, and are connected so that the waveguide axial directions thereof are parallel to the z-axis. The first feeding waveguide 21 is provided so that the wide wall surfaces thereof are parallel to the x-axis, whereas the second feeding waveguide 22 is provided so that the wide wall surfaces thereof are parallel to the y-axis.

Like in the first embodiment, a line-shaped conductor 8 is formed so that the longitudinal direction thereof is inclined by a predetermined inclination angle with respect to the waveguide axial direction of the second waveguide member 4, and multiple line-shaped conductors 8 are arranged corresponding to the arrangement intervals of the slots 6. Note that the inclination angles of the two line-shaped conductor patterns adjacent to the second feeding waveguide 22 are formed so as to be in the same direction, and inclination angles of other two adjacent line-shaped conductor patterns are formed so as to be in mutually opposite directions.

Other configurations are similar to those of the waveguide slot array antenna of the first embodiment, and thus corresponding parts are denoted by the same symbol, and description thereof will be omitted.

Next, the operation of the waveguide slot array antenna of the second embodiment will be described.

In the waveguide slot array antenna according to the second embodiment, like in the waveguide slot array antenna according to the first embodiment, a first waveguide 12 is formed by including the first groove 2 and the waveguide wall conductor 10*b*, and the first waveguide 12 has a component, in which the electric field vector is oriented in the z-axis direction, as the dominant mode. Meanwhile, the second groove 3 and the second waveguide member 4 are electrically connected at contact surfaces by the waveguide wall conductors 10*a* and 10*b* and vias 11 like in the first embodiment, and a second waveguide 13 is thereby formed. The second waveguide 13 has a component, in which the electric field vector is oriented in the x-axis direction, as the dominant mode.

Here, let us assume a case where a power supply terminal in the first waveguide 12 is an open end in the first feeding waveguide 21 on the side opposite to the connection portion with the first waveguide 12, a power supply terminal in the second waveguide 13 is an open end in the second feeding waveguide 22 on the side opposite to the connection portion with the second waveguide 13, and a high frequency signal is input to each of the power supply terminals so that the dominant modes of the first feeding waveguide 21 or the second feeding waveguide 22 are propagated efficiently.

First, the operation of the first waveguide 12 will be described. The first feeding waveguide 21 has a component, in which the electric field vector is oriented in the y-axis direction, as the dominant mode, and the connection portion between the first feeding waveguide 21 and the first waveguide 12 has a so-called E-surface T-branch waveguide structure, and as a result the dominant mode of the first waveguide 12 is input to a side of one of the short-circuit walls of the first waveguide 12 and a side of the other short-circuit wall as reversed phases as viewed from the first feeding waveguide 21. Furthermore, since both ends of the first waveguide 12 are short-circuit walls, so-called standing waves are excited inside the first waveguide 12.

Like the operation in the first embodiment, a polarized wave orthogonal to the axis of the first waveguide 12, that is, a vertically polarized radio wave, is radiated from a conductor-removed portion 9 to the external space, thereby allowing the conductor-removed portion 9 to operate as a vertically-polarized-wave radiation slot. In this example, as described above, since the dominant mode of the first waveguide 12 is input to both sides of the first waveguide 12 as reversed phases as viewed from the first feeding waveguide 21, the two conductor-removed portions 9 adjacent to the first feeding waveguide 21 are arranged so as to be in mutually opposite positions with respect to the waveguide axial center line of the first waveguide 12 so that the phases of radio waves radiated from these conductor-removed portions 9 are in phase. Furthermore, like in the first embodiment, adjacent conductor-removed portions 9 are arranged to form a zig-zag arrangement so as to be positioned opposite to each other with respect to the waveguide axial center line of the first waveguide 12, thereby allowing radio waves radiated by the respective conductor-removed portions 9 to be in phase.

Next, the operation of the second waveguide 13 will be described. The second feeding waveguide 22 has a component, in which the electric field vector is oriented in the x-axis direction, as the dominant mode, and the connection portion between the second feeding waveguide 22 and the second waveguide 13 has a so-called H-surface T-branch waveguide structure, and as a result the dominant mode of the second waveguide 13 is input to both sides of the second waveguide 13 as in phase as viewed from the second feeding waveguide 22. Furthermore, since both ends of the second waveguide 13 are short-circuit walls, so-called standing waves are excited inside the second waveguide 13.

Like in the case of the first embodiment, the line-shaped conductors 8 provided on the dielectric substrate 7 disturb the electromagnetic field distribution inside the waveguide, and thereby a current that flows obliquely with respect to the waveguide axial direction is generated on a narrow wall surface of the second waveguide 13, and with the slots 6 blocking this current, a polarized wave parallel to the waveguide axis of the second waveguide 13, that is, a horizontally polarized radio wave, is finally radiated to the external space.

In this example, as described above, the dominant mode of the second waveguide 13 is input to both sides of the second waveguide 13 as in phase as viewed from the second feeding waveguide 22, and thus in order to make the phases of radio waves radiated from the two slots 6 adjacent to the second feeding waveguide 22 to be in phase, the inclination angles of the line-shaped conductor patterns of the two line-shaped conductors 8 corresponding to these slots are formed so as to be mutually in the same direction. Meanwhile, the other line-shaped conductor patterns are formed so that the inclination angles of adjacent line-shaped conductor patterns are in mutually opposite directions, thereby allowing radio waves radiated from the slots 6 to be in phase like in the case of the first embodiment.

As described above, in the waveguide slot array antenna of the second embodiment, the first waveguide member 1*a* connected with the first feeding waveguide 21 and the second feeding waveguide 22 and the second waveguide member 4 including the slots 6 sandwich the dielectric substrate 7 on which conductor patterns are formed. A conductor-removed portion 9 formed in the dielectric substrate 7 operates as a vertically-polarized-wave radiation slot, and the amount of radiation power of a vertically polarized wave can be adjusted by the position and the shape of the conductor-removed portion 9. Furthermore, the amount of radiation power of a horizontally polarized wave can be adjusted by the shape of a line-shaped conductor 8. That is, in the second embodiment, the amount of radiation power of each of the slots that radiate a vertically polarized wave or a horizontally polarized wave can be adjusted only by the conductor pattern shape of the dielectric substrate 7, and thus, as in the first embodiment, the development cost can be reduced.

Furthermore, in the waveguide slot array antenna according to the second embodiment, the first feeding waveguide 21 and the second feeding waveguide 22 are connected to the surface opposite to the surface from which radio waves are radiated, and thus it is possible to array subarrays densely in two dimensions. That is, in a waveguide slot array antenna, a power supply terminal is generally connected with a distribution synthesis circuit or a transceiver. Here, when considering using the waveguide slot array antenna as illustrated in FIG. 11 as a sub-array and installing multiple waveguide slot array antennas in the y-axis direction, the first feeding waveguide 21 and the second feeding waveguide 22 which are power supply terminals are positioned on the side opposite to the surface from which radio waves are radiated, and thus the structures of the distribution synthesis circuit or the transceiver do not affect the arrangement in the y-axis direction. Therefore, it is possible to array the sub-arrays not only in the x-axis direction but also in the y-axis direction.

Note that, in the examples illustrated in FIGS. 11 to 14, the first feeding waveguide 21 is connected to the central portion of the first waveguide 12; however, the first feeding waveguide 21 may be connected to the first waveguide 12 at a position corresponding to an intermediate portion between any two adjacent conductor-removed portions 9 among the multiple arrayed conductor-removed portions 9. Likewise, in FIGS. 11 to 14, the second feeding waveguide 22 is connected to the central portion of the second waveguide 13; however, the second feeding waveguide 22 may be connected to the second waveguide 13 at a position corresponding to an intermediate portion between any two adjacent slots 6 among the multiple arrayed slots 6. This allows for flexibility in the position of the power supply terminals, and as a result, there are many options as to the arrangement of the transceiver to be connected to the back surface or the configuration of the distribution synthesis circuit, and thus the degree of freedom in designing a waveguide slot array antenna can be improved.

Figure 16:
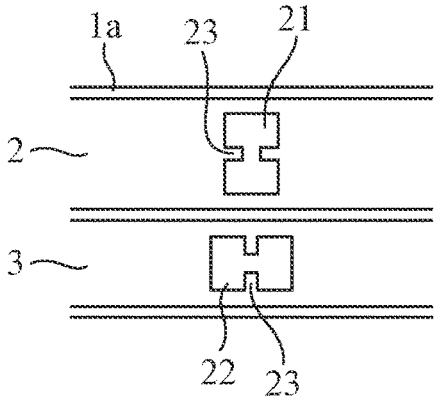
FIG. 16 is an explanatory diagram of modifications of the first feeding waveguide and the second feeding waveguide as viewed from the z-axis direction in the waveguide slot array antenna according to the second embodiment of the present invention.

Furthermore, the first feeding waveguide 21 and the second feeding waveguide 22 are rectangular waveguides as illustrated in FIG. 15; however, as illustrated in FIG. 16, second ridge conductors 23 serving as barriers having a predetermined projecting length on the waveguide axial center line may be provided on the wide wall surfaces of the first feeding waveguide 21 and the second feeding waveguide 22, to obtain such a structure as a so-called double ridge waveguide. As a result, the widths of the wide wall surfaces of the first feeding waveguide 21 and the second feeding waveguide 22 can be reduced, and as a result, the interaction between the first feeding waveguide 21 and the second feeding waveguide 22 and conductor-removed portions 9 or slots 6 adjacent thereto can be reduced. Note that these interactions cause deterioration of radiation characteristics.

Figure 17:
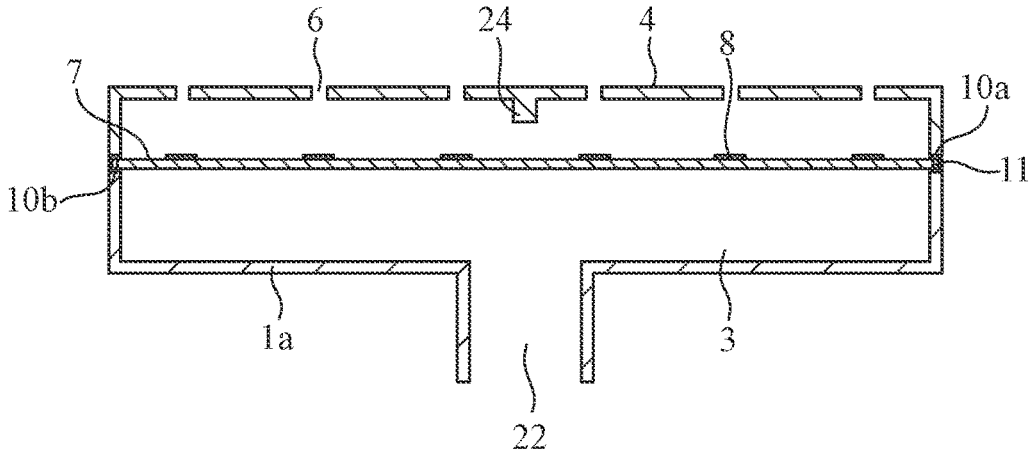
FIG. 17 is a cross-sectional view of a modification of the waveguide slot array antenna according to the second embodiment of the present invention.

Furthermore, in the waveguide slot array antenna illustrated in FIGS. 11 to 16, no additional structure is provided on the bottom surface of the third groove 5 nor the dielectric substrate 7 facing the connection portion between the second waveguide 13 and the second feeding waveguide 22; however, as illustrated in FIG. 17, an inductive barrier 24 for blocking a part of the path of the second waveguide 13 may be provided orthogonally to the waveguide axial direction on the bottom surface of the third groove 5 facing the connection portion between the second waveguide 13 and the second feeding waveguide 22.

Figure 18:
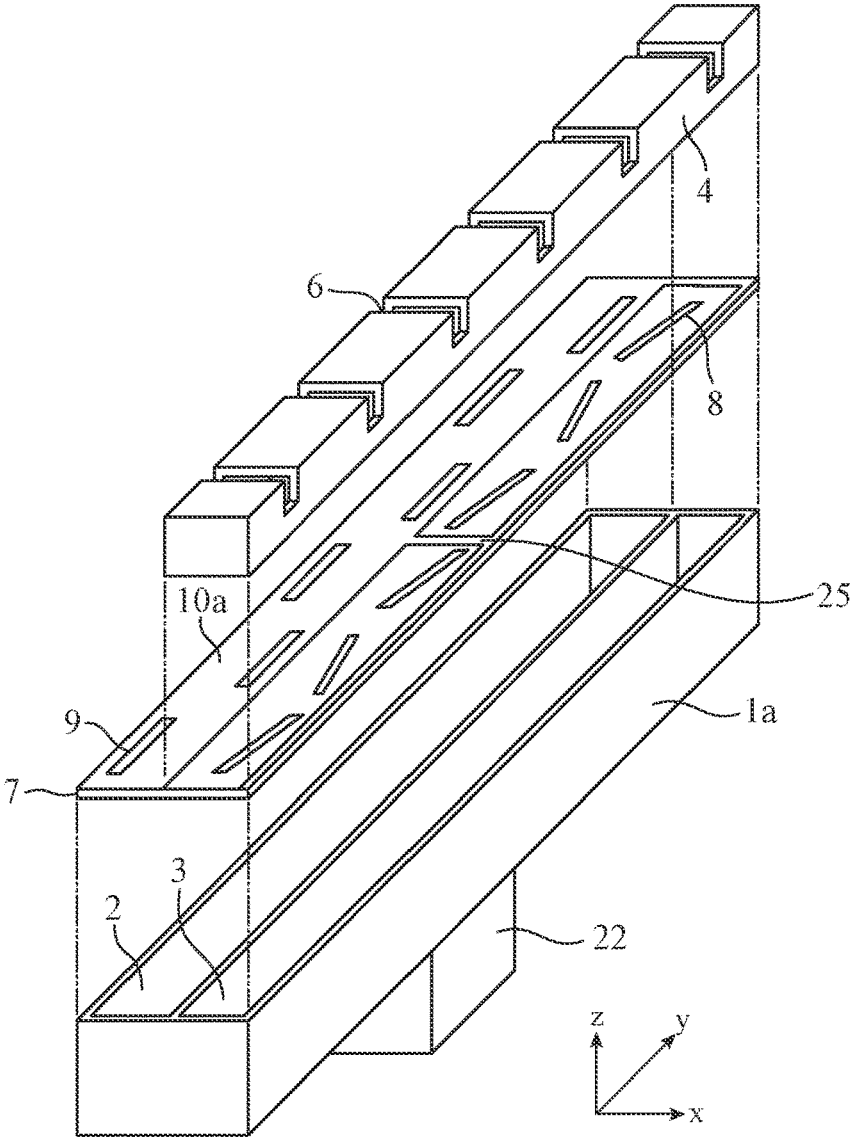
FIG. 18 is an exploded perspective view of the modification of the waveguide slot array antenna according to the second embodiment of the present invention.

Also as illustrated in FIG. 18, a line-shaped short-circuit conductor 25 orthogonal to the waveguide axial direction of the waveguides may be formed so as to be electrically connected to the waveguide wall conductor 10*a* at the connection portion with the second waveguide 13 and the second feeding waveguide 22 on the dielectric substrate 7. As a result, it is possible to improve the reflection characteristic at the connection portion with the second waveguide 13 as viewed from the second feeding waveguide 22.

As described above, the waveguide slot array antenna of the second embodiment includes: a first waveguide member having a first groove for forming a first waveguide, a second groove for forming a part of a second waveguide, and a short-circuit wall at each of two ends of the first waveguide member in a waveguide axial direction; a second waveguide member having a third groove for forming another part of the second waveguide having a same width as a width of the second groove, the third groove being arranged to face the second groove, a bottom surface of the third groove having a plurality of slots each of which is arranged to be orthogonal to a waveguide axial direction, and the second waveguide member having a short-circuit wall at each of two ends of the second waveguide member in a waveguide axial direction, a dielectric substrate provided between the first waveguide member and the second waveguide member and covering the first groove and the second groove; waveguide wall conductors provided on both sides of the dielectric substrate at portions in contact with the first waveguide member and the second waveguide member and a portion covering the first groove; a plurality of line-shaped conductors provided on the dielectric substrate at positions corresponding to the plurality of slots, respectively, each of the plurality of line-shaped conductors being provided obliquely with respect to the waveguide axial direction; a plurality of rectangular conductor-removed portions formed in the waveguide wall conductors in a position of the first groove, each of the plurality of rectangular conductor-removed portions being parallel to the waveguide axial direction; a plurality of vias connecting the waveguide wall conductors on both sides through the dielectric substrate; a first feeding waveguide having a rectangular cross-section, serving as a power supply terminal, and being provided on a bottom surface of the first groove so as to be positioned between adjacent two conductor-removed portions among the plurality of rectangular conductor-removed portions; and a second feeding waveguide having a rectangular cross-section, serving as a power supply terminal, and being provided on a bottom surface of the second groove so as to be positioned between adjacent two slots among the plurality of slots. Inclination directions of two line-shaped conductors, which are adjacent to an installation position of the second feeding waveguide among the plurality of line-shaped conductors, are in a same direction, and other adjacent line-shaped conductors among the plurality of line-shaped conductors are in opposite directions to each other. Therefore, it is possible to adjust the amount of radiation power only by modifying the conductor patterns on the dielectric substrate, thereby eliminating the need of remanufacturing the waveguide for refabricating a prototype in an antenna development process, and the development cost can be suppressed as a result.

Furthermore, according to the waveguide slot array antenna of the second embodiment, positions of adjacent conductor-removed portions among the plurality of rectangular conductor-removed portions are on opposite sides from each other with respect to the center line in the waveguide axial direction of the first groove, a distance between centers of the adjacent conductor-removed portions is one half of an in-waveguide wavelength at a design center frequency of a first waveguide including the first groove and the waveguide wall conductors, a distance between centers of adjacent slots among the plurality of slots is one half of an in-waveguide wavelength at a design center frequency of a second waveguide including the second groove, the third groove, the waveguide wall conductors, and the vias, and a distance in the waveguide axial direction between the short-circuit wall and a center of a conductor-removed portion adjacent to the short-circuit wall among the plurality of rectangular conductor-removed portions and a distance in the waveguide axial direction between the short-circuit wall and a center of a slot adjacent to the short-circuit wall among the plurality of slots is a quarter of an in-waveguide wavelength at a design center frequency of the first waveguide and the second waveguide, respectively. Therefore, a vertically polarized radio wave and a horizontally polarized radio wave can be efficiently radiated to the outside.

Moreover, according to the waveguide slot array antenna of the second embodiment, an inductive barrier for blocking a part of a path of the second waveguide is included, the inductive barrier being orthogonal to the waveguide axial direction and provided at a position on the bottom surface of the third groove corresponding to the second feeding waveguide. Thus it is possible to improve the reflection characteristic at the connection portion with the second waveguide as viewed from the second feeding waveguide.

Furthermore, according to the waveguide slot array antenna of the second embodiment, a short-circuit conductor having both ends connected to one of the waveguide wall conductors is included, the short-circuit conductor extending in an orthogonal direction to the waveguide axial direction and provided at a position on the dielectric substrate corresponding to the second feeding waveguide on the bottom surface of the third groove. Thus, it is possible to improve the reflection characteristic at the connection portion with the second waveguide as viewed from the second feeding waveguide.

In addition, according to the waveguide slot array antenna of the second embodiment, a second ridge conductor parallel to a waveguide axial direction of the first feeding waveguide and the second feeding waveguide provided on a wide waveguide wall surface of at least one of the first feeding waveguide and the second feeding waveguide is included. Thus, deterioration of radiation characteristics can be suppressed.

Further, according to the waveguide slot array antenna of the second embodiment, the waveguide slot array antenna is formed by arranging a plurality of waveguide slot array antennas in at least one of a waveguide axial direction or a direction orthogonal to the waveguide axial direction as sub-arrays, wherein each of the plurality of waveguide slot array antennas is a waveguide slot array antenna according to claim 9 or 10. Thus, an antenna densely arrayed in two dimensions can be obtained.

Third Embodiment

Figure 19:
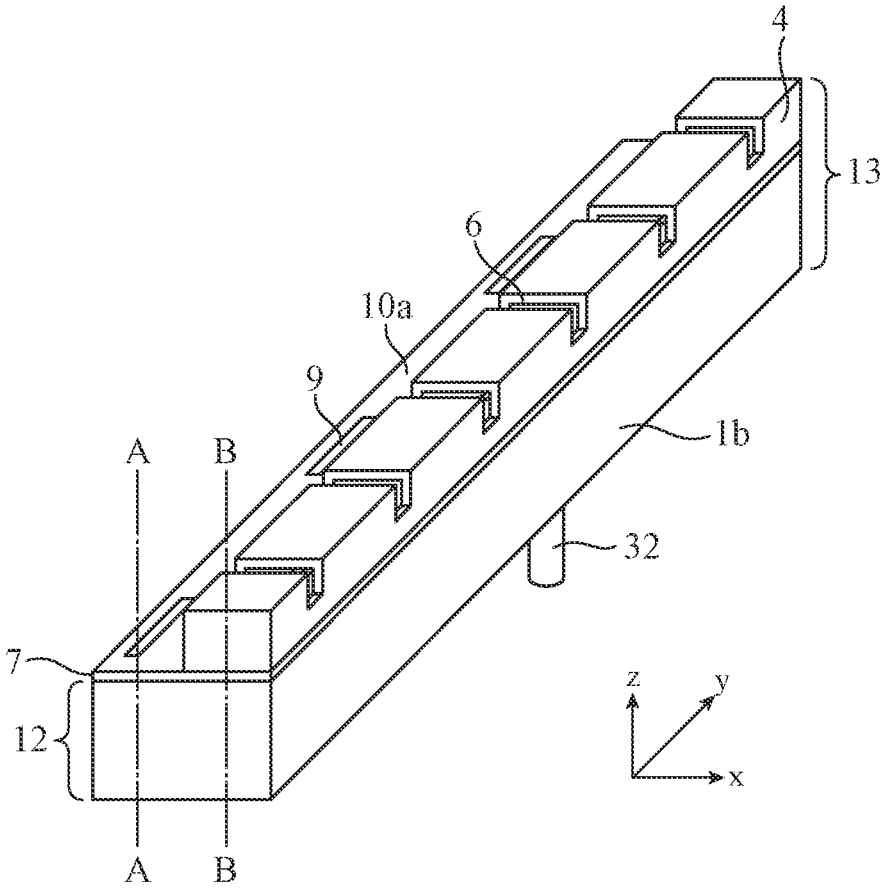
FIG. 19 is a perspective view of a waveguide slot array antenna according to a third embodiment of the present invention.
Figure 20:
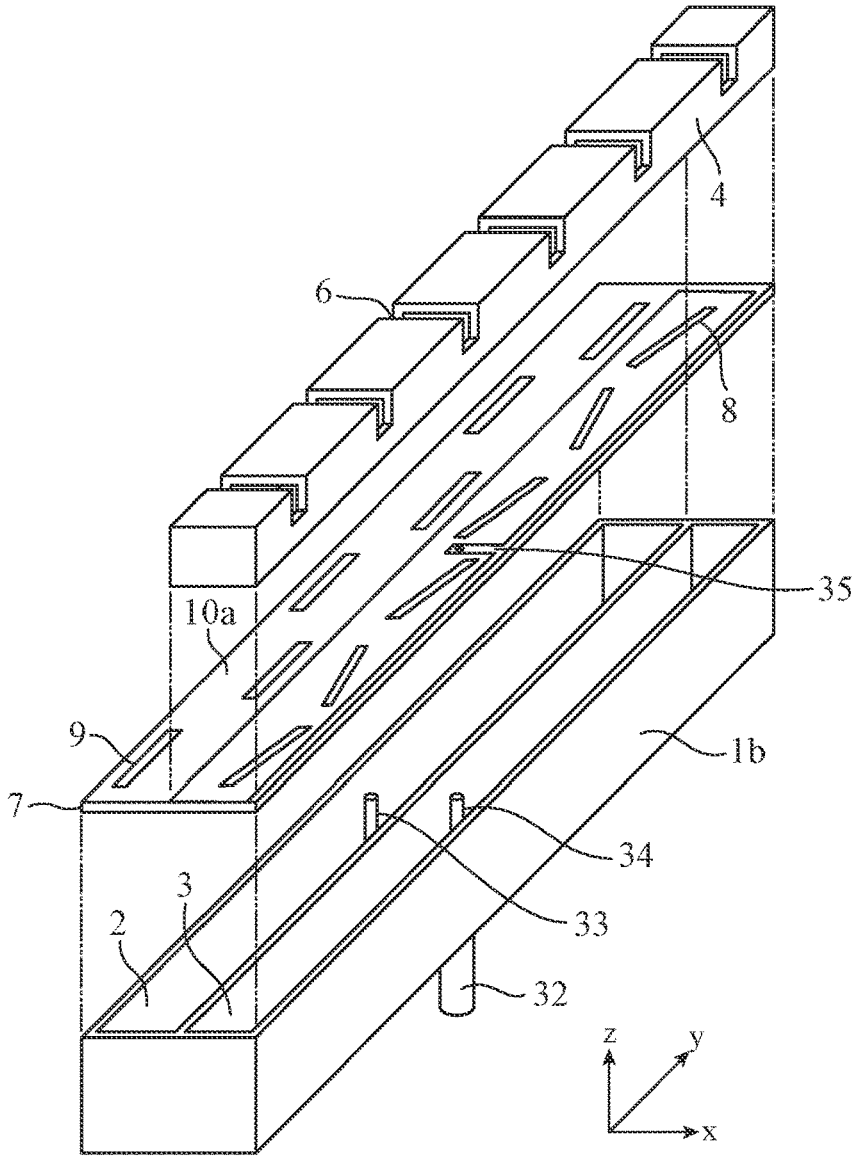
FIG. 20 is an exploded perspective view of the waveguide slot array antenna according to the third embodiment of the present invention.
Figure 21:
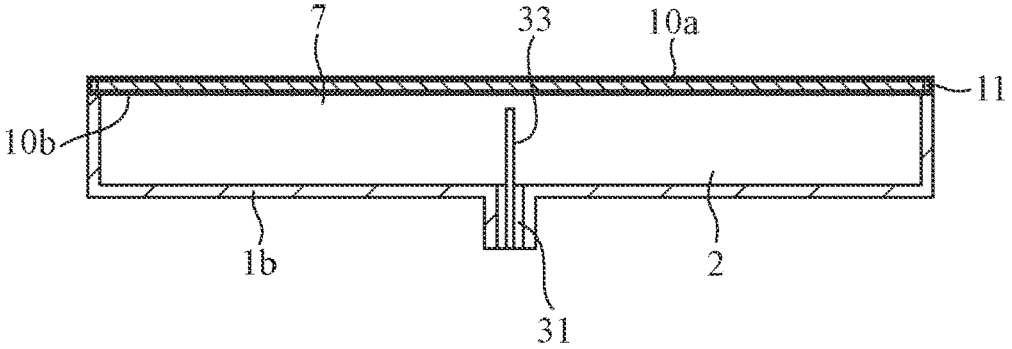
FIG. 21 is a cross-sectional view taken along a plane that is passing through line AA of FIG. 19 and is parallel to the waveguide axis.
Figure 22:
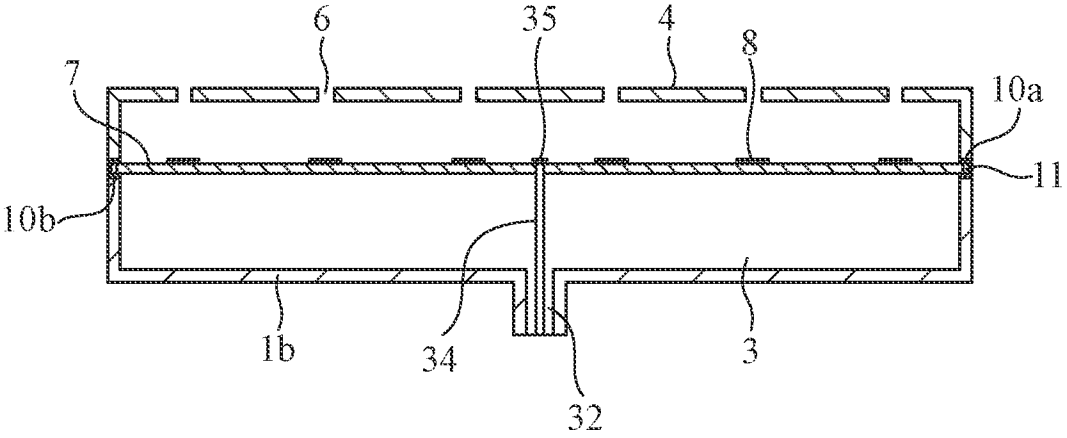
FIG. 22 is a cross-sectional view taken along a plane that is passing through line BB of FIG. 19 and is parallel to the waveguide axis.

A third embodiment is an example in which a feeding probe structure is provided in the central portion of a waveguide, and a power supply terminal at the base thereof is used as an input terminal. FIG. 19 is a perspective view of a waveguide slot array antenna according to the third embodiment. In FIG. 20, an exploded perspective view of the waveguide slot array antenna is further illustrated. In addition, FIG. 21 is a cross-sectional view taken along a plane that is passing through line AA of FIG. 19 and is parallel to a waveguide axis, and FIG. 22 is a cross-sectional view taken along a plane that is passing through line BB of FIG. 19 and is parallel to the waveguide axis.

As illustrated in these figures, the waveguide slot array antenna according to the third embodiment includes a first waveguide member 1*b*, a second waveguide member 4, a dielectric substrate 7, line-shaped conductors 8, conductor-removed portions 9, waveguide wall conductors 10*a* and 10*b*, vias 11, a first feeder line 31, a second feeder line 32, a first feeding probe 33, and a second feeding probe 34. The first waveguide member 1*b* is formed with a first groove 2 and a second groove 3 like in the first embodiment, and both ends thereof in the waveguide axial direction are each sealed with a short-circuit wall. In addition, round openings are formed in the central portions, in the waveguide axial direction, of the bottom surfaces of the first groove 2 and the second groove 3, and the first feeder line 31 and the second feeder line 32 are connected to the round openings thereof, respectively. The first feeder line 31 and the second feeder line 32 are coaxial lines. The first feeding probe 33 is connected to an inner conductor of the first feeder line 31, and the second feeding probe 34 is connected to an inner conductor of the second feeder line 32.

A probe conductor 35 is formed at a position on the dielectric substrate 7 corresponding to the connection position of the second feeder line 32. One end of the probe conductor 35 is connected to the waveguide wall conductor 10*a*, and the other end thereof is connected to the second feeding probe 34. The end of the second feeding probe 34 is drawn to the waveguide wall conductor 10*a* side of the dielectric substrate 7 through an opening for inserting the feeding probe formed in the dielectric substrate 7, and is electrically connected with the probe conductor 35 by means such as soldering. As a result, an L-shaped probe including the second feeding probe 34 and the probe conductor 35 is structured. Note that outer conductors of the first feeder line 31 and the second feeder line 32 are connected to wall surfaces of the waveguides.

Like in the first embodiment, the multiple line-shaped conductors 8 are formed so that the longitudinal direction thereof is inclined by a predetermined inclination angle with respect to the waveguide axial direction of the second waveguide member 4 and are arranged corresponding to the arrangement intervals of the multiple slots 6. Note that the two line-shaped conductors 8 centered at the connection position of the second feeder line 32 are formed so that the inclination angles thereof are mutually in the same direction, and other two adjacent line-shaped conductors 8 are formed so that the inclination angles thereof are mutually in opposite directions.

Like the first embodiment, the conductor-removed portions 9 are formed by removing portions of conductor patterns of the waveguide wall conductors 10*a* and 10*b* in rectangular shapes having long sides and short sides so that a longitudinal direction of each of the conductor-removed portions 9 is parallel to the waveguide axial direction of the first waveguide member 1*b*. Furthermore, adjacent conductor-removed portions 9 are arranged to form a zig-zag arrangement so as to be in mutually opposite positions with respect to the waveguide axial center line of the first groove 2; however, the two conductor-removed portions 9 adjacent to each other centered at the position corresponding the connection position of the first feeder line 31 are formed so as to be positioned on the same side with respect to the waveguide axial center line of the first groove 2. Other configurations are similar to those of the first embodiment, and thus corresponding parts are denoted by the same symbol, and description thereof will be omitted.

Next, the operation of the waveguide slot array antenna according to the third embodiment of the present invention will be described.

In the waveguide slot array antenna according to the third embodiment, like in the first embodiment, a first waveguide 12 is formed by including the first groove 2 and the waveguide wall conductor 10*b*, and the first waveguide 12 has a component, in which the electric field vector is oriented in the z-axis direction, as the dominant mode. Meanwhile, the second groove 3 and the second waveguide member 4 are electrically connected by the waveguide wall conductors 10*a* and 10*b* and vias 11, and a second waveguide 13 is thereby formed. The second waveguide 13 has a component, in which the electric field vector is oriented in the x-axis direction, as the dominant mode.

Here, let as assume a case where a power supply terminal of the first waveguide 12 is the first feeder line 31 and a power supply terminal of the second waveguide 13 is the second feeder line 32, and a high frequency signal is input to each of the power supply terminals.

First, the operation of the first waveguide 12 will be described. With the high frequency signal input to the first feeder line 31, a current flows in the first feeding probe 33 connected to the inner conductor of the first feeder line 31. With this current, the dominant mode of the first waveguide 12 are excited on both sides of the first waveguide 12 as in phase as viewed from the first feeder line 31. Furthermore, since both ends of the first waveguide 12 are short-circuit walls, so-called standing waves are excited inside the first waveguide 12.

Like the operation in the first embodiment, a polarized wave orthogonal to the waveguide axial direction of the first waveguide 12, that is, a vertically polarized radio wave, is radiated from a conductor-removed portion 9 to the external space, thereby allowing the conductor-removed portion 9 to operate as a vertically-polarized-wave radiation slot.

In this example, as described above, since the dominant mode of the first waveguide 12 is input to both sides of the first waveguide 12 as in phase as viewed from the first feeder line 31, the two conductor-removed portions 9 adjacent to the first feeding probe 33 are arranged at positions on the same side with respect to the waveguide axial center line of the first waveguide 12 so that the phases of radio waves radiated from these conductor-removed portions 9 are in phase. Other adjacent conductor-removed portions 9 are arranged to form a zig-zag arrangement so as to be positioned opposite to each other with respect to the waveguide axial center line of the first waveguide 12 like in the first embodiment, thereby allowing radio waves radiated by the respective conductor-removed portions 9 to be in phase.

Next, the operation of the second waveguide 13 will be described. With the high frequency signal input to the second feeder line 32, a current flows in the second feeding probe 34 and the probe conductor 35 connected to the inner conductor of the second feeder line 32. Of these, with the current flowing in the probe conductor 35, the dominant mode of the second waveguide 13 are excited on both sides of the second waveguide 13 as in phase as viewed from the second feeder line 32. Furthermore, since both ends of the second waveguide 13 are short-circuit walls, so-called standing waves are excited inside the second waveguide 13.

Like in the case of the operation in the first embodiment, the line-shaped conductors 8 provided on the dielectric substrate 7 disturb the electromagnetic field distribution inside the waveguide, and thereby a current that flows obliquely with respect to the waveguide axial direction is generated on a narrow wall surface of the second waveguide 13, and with the slots 6 blocking this current, a polarized wave parallel to the waveguide axis of the second waveguide 13, that is, a horizontally polarized wave, is finally radiated to the external space.

In this example, as described above, the dominant mode of the second waveguide 13 is excited on both sides of the second waveguide 13 as in phase as viewed from the second feeder line 32, and thus in order to make the phases of radio waves radiated from the two slots 6 adjacent to the second feeding probe 34 to be in phase, the two line-shaped conductors 8 corresponding to the two slots 6 are formed so that the inclination angles thereof are mutually in the same direction. Meanwhile, the other line-shaped conductors 8 are formed so that the inclination angles of adjacent line-shaped conductors 8 are in mutually opposite directions, thereby allowing radio waves radiated from the slots 6 to be in phase like in the first embodiment.

As described above, in the waveguide slot array antenna of the third embodiment, the first waveguide member 1*b* connected with the first feeder line 31 and the second feeder line 32 and the second waveguide member 4 including the slots 6 sandwich the dielectric substrate 7 on which conductor patterns are formed. A conductor-removed portion 9 formed in the dielectric substrate 7 operates as a vertically-polarized-wave radiation slot, and the amount of radiation power of a vertically polarized wave can be adjusted by the position and the shape of the conductor-removed portion 9. Furthermore, the amount of radiation power of a horizontally polarized wave can be adjusted by the shape of a line-shaped conductor 8.

That is, in the third embodiment, the amount of radiation power of each of the slots that radiate a vertically polarized wave or a horizontally polarized wave can be adjusted only by the conductor pattern shape of the dielectric substrate 7, and thus, as in the first embodiment, the development cost can be reduced.

Furthermore, in the waveguide slot array antenna according to the third embodiment, the first feeder line 31 and the second feeder line 32 are connected to the surface opposite to the surface from which radio waves are radiated, and thus it is possible to array subarrays densely in two dimensions, and it is easier to connect with other components having a coaxial connector as an interface such as a transceiver.

Note that, in the examples illustrated in FIGS. 19 to 22, the first feeder line 31 is connected to the central portion of the first waveguide 12; however, the first feeder line 31 may be connected to the first waveguide 12 at a position corresponding to an intermediate portion between any two adjacent conductor-removed portions 9 among the multiple arrayed conductor-removed portions 9. Likewise, in the above example, the second feeder line 32 is connected to the central portion of the second waveguide 13; however, the second feeder line 32 may be connected to the second waveguide 13 at a position corresponding to an intermediate portion between any two adjacent slots 6 among the multiple arrayed slots 6. This allows for flexibility in the position of the power supply terminals, and thus there are options as to the arrangement positions of the transceiver or the like to be connected to the back surface. As a result, the degree of freedom in designing an array antenna can be improved.

Furthermore, in the above example, the L-shaped probe is formed by including the second feeding probe 34 and the probe conductor 35; however, the probe conductor 35 may not be provided on the dielectric substrate 7, and the second feeding probe 34 may be directly bent into an L-shape and an end thereof may be connected to the waveguide wall surface.

As described above, the waveguide slot array antenna of the third embodiment includes: a first waveguide member having a first groove for forming a first waveguide, a second groove for forming a part of a second waveguide, and a short-circuit wall at each of two ends of the first waveguide member in a waveguide axial direction; a second waveguide member having a third groove for forming another part of the second waveguide having a same width as a width of the second groove, the third groove being arranged to face the second groove, a bottom surface of the third groove having a plurality of slots each of which is arranged to be orthogonal to a waveguide axial direction, and the second waveguide member having a short-circuit wall at each of two ends of the second waveguide member in a waveguide axial direction, a dielectric substrate provided between the first waveguide member and the second waveguide member and covering the first groove and the second groove; waveguide wall conductors provided on both sides of the dielectric substrate at portions in contact with the first waveguide member and the second waveguide member and a portion covering the first groove; a plurality of line-shaped conductors provided on the dielectric substrate at positions corresponding to the plurality of slots, respectively, each of the plurality of line-shaped conductors being provided obliquely with respect to the waveguide axial direction; a plurality of rectangular conductor-removed portions formed in the waveguide wall conductors in a position of the first groove, each of the plurality of rectangular conductor-removed portions being parallel to the waveguide axial direction; a plurality of vias connecting the waveguide wall conductors on both sides through the dielectric substrate; a first feeder line serving as a power supply terminal and being provided on a bottom surface of the first groove so as to be positioned between adjacent two conductor-removed portions among the plurality of rectangular conductor-removed portions; a second feeder line serving as a power supply terminal and being provided on a bottom surface of the second groove so as to be positioned between adjacent two slots among the plurality of slots; a first feeding probe connected to the first feeder line and positioned inside the first waveguide; and a second feeding probe having one end connected to the second feeder line and another end connected to one of the waveguide wall conductors, and positioned inside the second waveguide. Inclination directions of two line-shaped conductors, which are adjacent to an installation position of the second feeding probe among the plurality of line-shaped conductors, are in a same direction, other adjacent line-shaped conductors among the plurality of line-shaped conductors are in opposite directions to each other, two conductor-removed portions adjacent to the first feeding probe among the plurality of rectangular conductor-removed portions are positioned on a same side with respect to a waveguide axial center line of the first waveguide, and other two adjacent conductor-removed portions among the plurality of rectangular conductor-removed portions are positioned on opposite sides from each other with respect to the waveguide axial center line of the first waveguide. Therefore, it is possible to adjust the amount of radiation power only by modifying the conductor patterns on the dielectric substrate, thereby eliminating the need of remanufacturing the waveguide for refabricating a prototype in an antenna development process, and the development cost can be suppressed as a result.

According to the waveguide slot array antenna of the third embodiment, a distance between centers of adjacent conductor-removed portions among the plurality of rectangular conductor-removed portions is one half of an in-waveguide wavelength at a design center frequency of a first waveguide including the first groove and the waveguide wall conductors, a distance between centers of adjacent slots among the plurality of slots is one half of an in-waveguide wavelength at a design center frequency of a second waveguide including the second groove, the third groove, the waveguide wall conductors, and the vias, and a distance in the waveguide axial direction between the short-circuit wall and a center of a conductor-removed portion adjacent to the short-circuit wall among the plurality of rectangular conductor-removed portions and a distance in the waveguide axial direction between the short-circuit wall and a center of a slot adjacent to the short-circuit wall among the plurality of slots is a quarter of an in-waveguide wavelength at a design center frequency of the first waveguide and the second waveguide, respectively. Therefore, a vertically polarized radio wave and a horizontally polarized radio wave can be efficiently radiated to the outside.

Note that the present invention may include a flexible combination of the embodiments, a modification of any component of the embodiments, or an omission of any component in the embodiments within the scope of the present invention.

INDUSTRIAL APPLICABILITY

As described above, a waveguide slot array antenna according to the present invention relates to a structure for a dual-orthogonal polarized wave for radiating both a horizontally polarized wave and a vertically polarized wave and is suitable for use as an antenna in wireless communication or an antenna of a radar.

REFERENCE SIGNS LIST

1, 1*a*, 1*b*: first waveguide member, 2: first groove, 3: second groove, 4: second waveguide member, 5: third groove, 6: slot, 7: dielectric substrate, 8: line-shaped conductor, 9: conductor-removed portion, 10*a*, 10*b*: waveguide wall conductor, 11: via, 12: first waveguide, 13: second waveguide, 14: first ridge conductor, 21: first feeding waveguide, 22: second feeding waveguide, 23: second ridge conductor, 24: inductive barrier, 25: short-circuit conductor, 31: first feeder line, 32: second feeder line, 33: first feeding probe, 34: second feeding probe, 35: probe conductor

The invention claimed is:

1. A waveguide slot array antenna, comprising:

a first waveguide member having a first groove for forming a first waveguide, and a second groove for forming a part of a second waveguide;

a second waveguide member having a third groove for forming another part of the second waveguide having a same width as a width of the second groove, the third groove being arranged to face the second groove, a bottom surface of the third groove having a plurality of slots each of which is arranged to be orthogonal to a waveguide axial direction;

a dielectric substrate provided between the first waveguide member and the second waveguide member and covering the first groove and the second groove;

waveguide wall conductors provided on both sides of the dielectric substrate, respectively, at portions in contact with the first waveguide member and the second waveguide member and a portion covering the first groove;

a plurality of line-shaped conductors provided on the dielectric substrate at positions corresponding to the plurality of slots, respectively, each of the plurality of line-shaped conductors being provided obliquely with respect to the waveguide axial direction;

a plurality of rectangular conductor-removed portions formed in the waveguide wall conductors in a position of the first groove, each of the plurality of rectangular conductor-removed portions being parallel to the waveguide axial direction; and a plurality of vias connecting the waveguide wall conductors on both the sides through the dielectric substrate.

2. The waveguide slot array antenna according to claim 1, wherein each of the plurality of line-shaped conductors includes a plurality of line-shaped conductor patterns being parallel to each other.

3. The waveguide slot array antenna according to claim 1, further comprising extension conductors each having one end connected to one of the waveguide wall conductors and another end extending toward one of the plurality of line-shaped conductors, the extension conductors being provided on the dielectric substrate on both sides of each of the plurality of line-shaped conductors to extend in a direction orthogonal to the waveguide axial direction.

4. The waveguide slot array antenna according to claim 3, wherein the extension conductors on both sides of any one of the plurality of line-shaped conductors are provided along a linear line.

5. The waveguide slot array antenna according to claim 1, further comprising a first ridge conductor positioned at a central part of the first groove in a direction orthogonal to the waveguide axial direction and extending in a direction parallel to the waveguide axial direction.

6. The waveguide slot array antenna according to claim 1, wherein, in the waveguide axial direction, one end of each of the first waveguide member and the second waveguide member is a short-circuit wall and another end thereof is a power supply terminal, inclination directions of adjacent line-shaped conductors, among the plurality of line-shaped conductors, are in different directions from each other with respect to the waveguide axial direction, and positions of adjacent conductor-removed portions among the plurality of rectangular conductor-removed portions are on opposite sides from each other with respect to a center line extending in the waveguide axial direction of the first groove.

7. The waveguide slot array antenna according to claim 6, wherein a distance between centers of the adjacent conductor-removed portions is one half of an in-waveguide wavelength at a design center frequency of a first waveguide including the first groove and the waveguide wall conductors, a distance between centers of adjacent slots among the plurality of slots is one half of an in-waveguide wavelength at a design center frequency of a second waveguide including the second groove, the third groove, the waveguide wall conductors, and the vias, and a distance in the waveguide axial direction between the short-circuit wall and a center of a conductor-removed portion adjacent to the short-circuit wall among the plurality of rectangular conductor-removed portions and a distance in the waveguide axial direction between the short-circuit wall and a center of a slot adjacent to the short-circuit wall among the plurality of slots is a quarter of an in-waveguide wavelength at a design center frequency of the first waveguide and the second waveguide, respectively.

8. A waveguide slot array antenna formed by arranging a plurality of waveguide slot array antennas in a direction orthogonal to a waveguide axial direction as sub-arrays, wherein each of the plurality of waveguide slot array antennas is a waveguide slot array antenna according to claim 1.

9. A waveguide slot array antenna, comprising:

a first waveguide member having a first groove for forming a first waveguide, a second groove for forming a part of a second waveguide, and a short-circuit wall at each of two ends of the first waveguide member in a waveguide axial direction;

a second waveguide member having a third groove for forming another part of the second waveguide having a same width as a width of the second groove, the third groove being arranged to face the second groove, a bottom surface of the third groove having a plurality of slots each of which is arranged to be orthogonal to a waveguide axial direction, and the second waveguide member having a short-circuit wall at each of two ends of the second waveguide member in a waveguide axial direction, a dielectric substrate provided between the first waveguide member and the second waveguide member and covering the first groove and the second groove;

waveguide wall conductors provided on both sides of the dielectric substrate at portions in contact with the first waveguide member and the second waveguide member and a portion covering the first groove;

a plurality of line-shaped conductors provided on the dielectric substrate at positions corresponding to the plurality of slots, respectively, each of the plurality of line-shaped conductors being provided obliquely with respect to the waveguide axial direction;

a plurality of rectangular conductor-removed portions formed in the waveguide wall conductors in a position of the first groove, each of the plurality of rectangular conductor-removed portions being parallel to the waveguide axial direction;

a plurality of vias connecting the waveguide wall conductors on both the sides through the dielectric substrate;

a first feeding waveguide having a rectangular cross-section, serving as a power supply terminal, and being provided on a bottom surface of the first groove so as to be positioned between adjacent two conductor-removed portions among the plurality of rectangular conductor-removed portions; and a second feeding waveguide having a rectangular cross-section, serving as a power supply terminal, and being provided on a bottom surface of the second groove so as to be positioned between adjacent two slots among the plurality of slots, wherein inclination directions of two line-shaped conductors, which are adjacent to an installation position of the second feeding waveguide among the plurality of line-shaped conductors, are in a same direction, and other adjacent line-shaped conductors among the plurality of line-shaped conductors are in opposite directions to each other.

10. The waveguide slot array antenna according to claim 9, wherein positions of adjacent conductor-removed portions among the plurality of rectangular conductor-removed portions are on opposite sides from each other with respect to the center line in the waveguide axial direction of the first groove, a distance between centers of the adjacent conductor-removed portions is one half of an in-waveguide wavelength at a design center frequency of a first waveguide including the first groove and the waveguide wall conductors, a distance between centers of adjacent slots among the plurality of slots is one half of an in-waveguide wavelength at a design center frequency of a second waveguide including the second groove, the third groove, the waveguide wall conductors, and the vias, and a distance in the waveguide axial direction between the short-circuit wall and a center of a conductor-removed portion adjacent to the short-circuit wall among the plurality of rectangular conductor-removed portions and a distance in the waveguide axial direction between the short-circuit wall and a center of a slot adjacent to the short-circuit wall among the plurality of slots is a quarter of an in-waveguide wavelength at a design center frequency of the first waveguide and the second waveguide, respectively.

11. The waveguide slot array antenna according to claim 9, further comprising:

an inductive barrier for blocking a part of a path of the second waveguide, the inductive barrier being orthogonal to the waveguide axial direction and provided at a position on the bottom surface of the third groove corresponding to the second feeding waveguide.

12. The waveguide slot array antenna according to claim 9, further comprising:

a short-circuit conductor having both ends connected to one of the waveguide wall conductors, the short-circuit conductor extending in an orthogonal direction to the waveguide axial direction and provided at a position on the dielectric substrate corresponding to the second feeding waveguide.

13. The waveguide slot array antenna according to claim 9, further comprising a second ridge conductor parallel to a waveguide axial direction of the first feeding waveguide and the second feeding waveguide provided on a wide waveguide wall surface of at least one of the first feeding waveguide and the second feeding waveguide.

14. A waveguide slot array antenna formed by arranging a plurality of waveguide slot array antennas in at least one of a waveguide axial direction or a direction orthogonal to the waveguide axial direction as sub-arrays, wherein each of the plurality of waveguide slot array antennas is a waveguide slot array antenna according to claim 9.

15. A waveguide slot array antenna, comprising:

a first waveguide member having a first groove for forming a first waveguide, a second groove for forming a part of a second waveguide, and a short-circuit wall at each of two ends of the first waveguide member in a waveguide axial direction;

a second waveguide member having a third groove for forming another part of the second waveguide having a same width as a width of the second groove, the third groove being arranged to face the second groove, a bottom surface of the third groove having a plurality of slots each of which is arranged to be orthogonal to a waveguide axial direction, and the second waveguide member having a short-circuit wall at each of two ends of the second waveguide member in a waveguide axial direction, a dielectric substrate provided between the first waveguide member and the second waveguide member and covering the first groove and the second groove;

waveguide wall conductors provided on both sides of the dielectric substrate at portions in contact with the first waveguide member and the second waveguide member and a portion covering the first groove;

a plurality of line-shaped conductors provided on the dielectric substrate at positions corresponding to the plurality of slots, respectively, each of the plurality of line-shaped conductors being provided obliquely with respect to the waveguide axial direction;

a plurality of rectangular conductor-removed portions formed in the waveguide wall conductors in a position of the first groove, each of the plurality of rectangular conductor-removed portions being parallel to the waveguide axial direction;

a plurality of vias connecting the waveguide wall conductors on both the sides through the dielectric substrate;

a first feeder line serving as a power supply terminal and being provided on a bottom surface of the first groove so as to be positioned between adjacent two conductor-removed portions among the plurality of rectangular conductor-removed portions;

a second feeder line serving as a power supply terminal and being provided on a bottom surface of the second groove so as to be positioned between adjacent two slots among the plurality of slots;

a first feeding probe connected to the first feeder line and positioned inside the first waveguide; and a second feeding probe having one end connected to the second feeder line and another end connected to one of the waveguide wall conductors, and positioned inside the second waveguide, wherein inclination directions of two line-shaped conductors, which are adjacent to an installation position of the second feeding probe among the plurality of line-shaped conductors, are in a same direction, other adjacent line-shaped conductors among the plurality of line-shaped conductors are in opposite directions to each other, two conductor-removed portions adjacent to the first feeding probe among the plurality of rectangular conductor-removed portions are positioned on a same side with respect to a waveguide axial center line of the first waveguide, and other two adjacent conductor-removed portions among the plurality of rectangular conductor-removed portions are positioned on opposite sides from each other with respect to the waveguide axial center line of the first waveguide.

16. The waveguide slot array antenna according to claim 15, wherein a distance between centers of adjacent conductor-removed portions among the plurality of rectangular conductor-removed portions is one half of an in-waveguide wavelength at a design center frequency of a first waveguide including the first groove and the waveguide wall conductors, a distance between centers of adjacent slots among the plurality of slots is one half of an in-waveguide wavelength at a design center frequency of a second waveguide including the second groove, the third groove, the waveguide wall conductors, and the vias, and a distance in the waveguide axial direction between the short-circuit wall and a center of a conductor-removed portion adjacent to the short-circuit wall among the plurality of rectangular conductor-removed portions and a distance in the waveguide axial direction between the short-circuit wall and a center of a slot adjacent to the short-circuit wall among the plurality of slots is a quarter of an in-waveguide wavelength at a design center frequency of the first waveguide and the second waveguide, respectively.

* * * * *